US011682875B2

(12) United States Patent
Weisheit et al.

(10) Patent No.: US 11,682,875 B2
(45) Date of Patent: Jun. 20, 2023

(54) PRESSING JAWS FOR CRIMPING PLIERS

(71) Applicant: Rennsteig Werkzeuge GmbH, Steinbach-Hallenberg (DE)

(72) Inventors: Benjamin Weisheit, Floh-Seligenthal (DE); Georg Holland-Moritz, Steinbach-Hallenberg (DE); Gerhard Koenig, Steinbach-Hallenberg (DE); Marko Endter, Steinbach-Hallenberg (DE); Ralf Legler, Altersbach (DE)

(73) Assignee: Rennsteig Werkzeuge GmbH, Steinbach-Hallenberg (DE)

( * ) Notice: Subject to any disclaimer, the term of this patent is extended or adjusted under 35 U.S.C. 154(b) by 477 days.

(21) Appl. No.: 16/757,466

(22) PCT Filed: Nov. 7, 2018

(86) PCT No.: PCT/EP2018/080469
§ 371 (c)(1),
(2) Date: Apr. 20, 2020

(87) PCT Pub. No.: WO2019/105703
PCT Pub. Date: Jun. 6, 2019

(65) Prior Publication Data

US 2021/0194198 A1 Jun. 24, 2021

(30) Foreign Application Priority Data

Dec. 1, 2017 (DE) ..... 10 2017 128 579.2
Jan. 19, 2018 (DE) ..... 10 2018 101 159.8

(51) Int. Cl.
*H01R 43/042* (2006.01)
*B25B 5/16* (2006.01)
(Continued)

(52) U.S. Cl.
CPC ..... *H01R 43/0424* (2013.01); *B25B 5/163* (2013.01); *B25B 7/12* (2013.01);
(Continued)

(58) Field of Classification Search
CPC ..... H01R 43/0424; H01R 43/048; H01R 43/058; H01R 43/0585; B25B 5/163; B25B 27/146
See application file for complete search history.

(56) References Cited

U.S. PATENT DOCUMENTS 2,109,837 A 3/1938 Davis
2,411,838 A * 11/1946 Swengel ..... H01R 43/042 72/409.14
(Continued)

FOREIGN PATENT DOCUMENTS

DE 198 18 482 C1 11/1999
DE 102 42 345 B3 2/2004
(Continued)

OTHER PUBLICATIONS

International Search Report of PCT/EP2018/080470, dated Jan. 24, 2019.
(Continued)

*Primary Examiner* — Jeffrey T Carley
(74) *Attorney, Agent, or Firm* — Collard & Roe, P.C.

(57) ABSTRACT

Pressing jaws for opposite arrangement in crimping pliers, the pressing jaws having ribs, which extend in a rib longitudinal direction and move into each other during pressing. A guide surface extending transversely to the rib longitudinal direction outside of a working region of the ribs is formed, which guide surface interacts with a guide protrusion extending from the opposite pressing jaw. In another version, the pressing jaws have ribs, which are designed to mesh with each other and which have a rib longitudinal
(Continued)

direction. Crimping pliers comprise two plier jaws, which are provided with oppositely arranged pressing jaws having ribs, which extend in a rib longitudinal direction and which, during pressing, move into each other and delimit a pressing jaw opening.

6 Claims, 25 Drawing Sheets

(51) Int. Cl.
*B25B 7/12* (2006.01)
*H01R 43/048* (2006.01)
*B25B 27/14* (2006.01)
*H01R 43/058* (2006.01)

(52) U.S. Cl.
CPC ..... *B25B 27/14* (2013.01); *H01R 43/048* (2013.01); *H01R 43/058* (2013.01); *H01R 43/0585* (2013.01)

(56) References Cited

U.S. PATENT DOCUMENTS 2,744,428 A * 5/1956 Evans ..... H01R 43/042 72/411
2,853,908 A * 9/1958 Logan ..... H01R 43/042 76/101.1
3,067,489 A 12/1962 Hoffman
3,314,135 A * 4/1967 Smith ..... B25B 27/146 29/751
3,557,429 A * 1/1971 Parsons ..... H01R 43/0421 29/56.6
3,771,343 A * 11/1973 Dawson ..... H01R 43/0424 72/402
4,199,972 A * 4/1980 Wiener ..... B25B 7/00 81/419
4,283,933 A 8/1981 Wiener
4,337,635 A * 7/1982 Martin ..... H01R 43/058 72/416
5,117,671 A 6/1992 Aikens et al.
5,228,325 A 7/1993 Wiebe et al.
6,151,950 A 11/2000 Wilhelm et al.
6,176,116 B1 1/2001 Wilhelm et al.
6,910,363 B2 6/2005 Beetz et al.
2003/0131647 A1* 7/2003 Chin ..... H01R 43/042 72/409.07
2004/0159194 A1* 8/2004 Ting ..... B25B 7/06 81/416
2011/0030447 A1* 2/2011 Backenstoes ..... H01R 43/042 72/409.14
2011/0197647 A1* 8/2011 Springston, II ..... H01R 43/042 72/409.1
2015/0372435 A1* 12/2015 Li ..... H01R 43/042 29/751
2017/0170618 A1* 6/2017 Ho ..... B25B 27/146
2017/0201056 A1* 7/2017 Malloy ..... H01R 43/058
2020/0223041 A1 7/2020 Ullbors
2021/0336399 A1* 10/2021 Glockseisen ..... B25B 27/146

FOREIGN PATENT DOCUMENTS

EP 0 516 598 A1 12/1992
EP 0 471 977 B1 6/1995
EP 0 732 779 B1 9/1998
EP 3 179 580 A1 6/2017
FR 2 886 874 A1 12/2006
WO WO-2022029320 A2 * 2/2022

OTHER PUBLICATIONS

International Search Report of PCT/EP2018/080469, dated Apr. 12, 2019.

* cited by examiner

PRESSING JAWS FOR CRIMPING PLIERS

CROSS REFERENCE TO RELATED APPLICATIONS

This application is the National Stage of PCT/EP2018/080469 filed on Nov. 7, 2018, which claims priority under 35 U.S.C. § 119 of German Application No. 10 2017 128 579.2 filed on Dec. 1, 2017 and German Application No. 10 2018 101 159.8 filed on Jan. 19, 2018, the disclosures of which are incorporated by reference. The international application under PCT article 21(2) was not published in English.

FIELD OF TECHNOLOGY

The invention firstly relates to two pressing jaws provided for opposite arrangement in crimping pliers, wherein the pressing jaws have ribs running in a rib longitudinal direction, which move into each other during pressing.

The invention further relates to pressing jaws for crimping pliers comprising ribs configured to mesh with each other, which have a rib longitudinal direction, wherein the ribs each have a free end face assigned to the other pressing jaw.

In addition, the invention relates to crimping pliers having two plier jaws which are provided with oppositely arranged pressing jaws.

The invention also relates to two pressing jaws provided for opposite arrangement in crimping pliers, wherein the pressing jaws have ribs running in a rib longitudinal direction, which move into each other during pressing, and thereby delimit a pressing jaw opening, wherein the ribs of a pressing jaw are arranged in the form of two rib families which are formed from a plurality of ribs extending adjacent to one another, and the ribs of one rib family at the free ends thereof relative to a view perpendicular to a bringing-together direction during moving into one another and when viewed on a broad side of the ribs each have a ridge line.

The invention further relates to a method for pressing conductor ends received in a core end sleeve for withdrawal-proof connection of the core end sleeve to the conductor ends by deformation, starting from a substantially circular cross-section of the core end sleeve into a substantially rectangular cross-section, wherein the core end sleeve has a wall and a wall outer surface.

PRIOR ART

Pressing jaws of the type in question as well as crimping pliers which preferably comprise such pressing jaws are known. These serve, for example, to crimp conductor ends, for example, using a core end sleeve. The pressing jaws used for this purpose are moulded parts configured to move into one another, optionally having ribs. Known crimping pliers have plier jaws to which pressing jaws are fastened. The plier jaws can be opened or closed in the manner of pliers or scissors.

Crimping pliers of the type in question are known, for example, from EP 0 732 779 B1 (U.S. Pat. No. 6,176,116 B1). Furthermore, in particular pressing jaws of the type in question are also known from DE 198 18 482 C1 (U.S. Pat. No. 6,151,950 A).

SUMMARY OF THE INVENTION

With a view to the previously described prior art, one object of the invention is seen to be further improving pressing jaws, as also crimping pliers and a method of the type in question in terms of handling technique and with a view to the crimping to be achieved.

A possible solution of the object is given according to a first inventive idea in pressing jaws in which the focus is on the fact that a guide surface running transversely to the rib longitudinal direction outside of a working region of the ribs is formed, which cooperates with a guide protrusion starting from the opposite pressing jaw.

As a result of this configuration, a guidance of the pressing jaws in particular in the course of a pressing process and the accompanying moving into one another of the pressing jaws is given. Any forces acting in the rib longitudinal direction on the one and/or the other pressing jaw in the course of a pressing, which could bring about a displacement of the one pressing jaw relative to the other pressing jaw in the rib longitudinal direction are absorbed as a result of the cooperation of the guide surface of one pressing jaw and the guide protrusion of the other pressing jaw. This results in an orderly pressing or crimping. The guide surface can be given on a guide protrusion of the respectively other pressing jaw. However, it can also be given on another formation of the other pressing jaw. For example, the guide surface can also be given on an associated (end) region of one or more ribs of the other pressing jaw.

In a preferred configuration, the guide protrusion of the one pressing jaw projects for this purpose beyond a dividing plane of the pressing jaws directed transversely to the bringing-together direction of the pressing jaws, for preferred abutment against the guide surface of the other pressing jaw.

The guide surface can, as fundamentally addressed, be formed, for example, by a rib end face which delimits the ribs (of the other pressing jaw) in their longitudinal extension.

A further possible solution of the object is given in pressing jaws in which the focus is on the fact that the end face when viewed in a cross-section transverse to the rib longitudinal direction has a rounded contour line projecting the furthest at the centre.

As a result of the proposed cross-sectional configuration, preferably of each rib in the front-side region, an improved pressing or crimping, for example, of core end sleeves is obtained. All the ribs of one or both pressing jaws can have the rounded contour line.

The furthest projecting region of the end face pointing in the direction of the opposite pressing jaw or its groove base between two ribs leaving a groove in between them is preferably substantially rounded, in this case optionally having a radius which remains continuously the same over the extension length of the rounded contour line, furthermore optionally also having different radii with regard to the rounded contour line. Preferably in this case, a part of the end face contour is provided with a radius in each case which is smaller than the dimension of a rib thickness transversely to the rib longitudinal direction, thus, for example, corresponding to 0.5 to 0.3 times the thickness.

In crimping pliers of the type in question, a possible solution of the object according to a further inventive idea is given by the fact that the pressing jaws are rotatable jointly about a twist axis directed in the direction of bringing together the pressing jaws and that the pressing jaws are also rotatable about the twist axis in the brought-together state without hindrance by a plier jaw.

Even in a brought-together state, the pressing jaws have no overhang which would collide with the upper and/or lower plier jaw during a rotation. If guide protrusions are provided, this is also achieved by the fact that the guide tasks which are to be furnished by the guide protrusions are distributed over the associated guide surfaces of the respectively opposite pressing jaw, i.e. over both pressing jaws. In the given case, the guide protrusions are also formed so that they only move so far into one another that during a rotation of the pressing jaw about the said twist axis, no collision with the plier jaws is obtained.

As a result of this configuration, crimping pliers particularly improved with regard to handling are specified. As a result of twisting about the twist axis, the pressing jaw pair can be twisted into a favourable position for a pressing or crimping to be carried out. The pressing jaws are in this case configured so that such twisting of the pressing jaw pair is preferably made possible in each bringing-together position, accordingly also in the completely brought-together position.

The previously described configuration to enable a twisting of the pressing jaw pair even in the brought-together state is also obtained in a pressing jaw pair having a guide surface running transversely to the rib longitudinal direction outside a working region of the ribs, which cooperates with a guide surface starting from the opposite pressing jaw.

Furthermore, the pressing jaw can also alternatively or combinatively to the previously described pressing jaw have at least one pressing jaw, the rib-side end face whereof, when viewed in a cross-section transverse to the rib longitudinal direction has a rounded contour line projecting the furthest at the centre.

With regard to the configuration of the pressing jaws, according to a further inventive idea, it can be provided that the ridge lines in each case of a rib family in the said view have a protuberance which projects into the pressing jaw opening.

Thus, a, for example, convex protuberance in the direction of the pressing jaw opening is preferably obtained from a strictly continuously rectilinear configuration of the ridge line. This protuberance can, as is also preferred, be provided partially, accordingly only over a partial region in relation to the longitudinal extension of the ridge line.

As a result of such a configuration, a cross-sectional shape which differs from an otherwise optionally strictly rectangular-geometrical cross-sectional shape of the pressing jaw opening can be obtained.

With regard to the specified method, a possible solution of the object can be given by the fact that by using pressing jaws having a protuberance configured in relation to the previously described ridge lines, the pressing jaws initially with the protuberances formed on the ribs are brought in contact with the wall outer surface of the core end sleeve and with the aid of the protuberances during further pressing concavely running wall sections are formed in the substantially rectangular wall of the deformed core end sleeve.

As a result of the proposed method, a favourable deformation of the workpiece or the core end sleeve is obtained. In particular, an almost complete filling of the cross-section with conductor ends can be achieved by this means relative to a cross-section through the pressed core end sleeve transversely to the longitudinal extension of the received conductor ends. As a result of the proposed pressing method, preferably small cavities are obtained, which can allow a displacement of conductor ends even after pressing and thus optionally lead to a loosening of the conductor ends. The free inner cross-section of the deformed core end sleeve is preferably completely quasi-homogeneously filled with conductor ends. As a result, a homogenized arrangement of the conductor ends in the core end sleeve can also be achieved.

In the course of the pressing process, firstly the protuberances reach the wall outer surface of the core end sleeve, accordingly acting on these initially. Accordingly, concavely running wall sections of the wall of the core end sleeve are obtained in the region of this action by the protuberances.

Further features of the invention are explained hereinafter, also in the description of the figures, frequently in their preferred assignment to the subject matter of claim 1 and/or one or more of the further independent claims or to features of further claims. However, they can also be of importance in an assignment to only individual features of claim 1 and/or one or more of the further independent claims or the respective further claims or independently in each case.

Thus, accordingly in a preferred embodiment opposite guide protrusions are formed on each pressing jaw relative to the rib longitudinal direction. These guide protrusions cooperate in the preferred embodiment with correspondingly opposite guide surfaces of the opposite pressing jaw likewise relative to the rib longitudinal direction. As a result, the guidance of the pressing jaws in particular in the course of bringing together is further improved. A displacement of the pressing jaws relative to one another transversely to the bringing-together direction is also hindered as a result of the given support.

The guide protrusions can be formed the same with regard to their cross-section transversely to the longitudinal extension thereof, furthermore transversely to the bringing-together direction, and also furthermore preferably with regard to the longitudinal extension thereof. The same applies according to a preferred embodiment in relation to the guide surfaces.

According to a further preferred embodiment, the multiple opposite guide protrusions can be formed on a first side of the pressing jaw, with an insertion opening which remains transverse with respect to the rib longitudinal direction. In the region of the insertion opening, the guide surface for a guide protrusion of the opposite pressing jaw is obtained. Furthermore, by insertion of a guide protrusion of one pressing jaw between two guide protrusions of the other pressing jaw on the one hand by abutment against the guide surface in the region of the insertion opening, a guidance in the rib longitudinal direction can thus be achieved and by abutment against the adjacent guide protrusions in the bringing-together direction, a guidance transversely to the rib longitudinal direction can be achieved.

The rounded contour line of the rib end face which projects the furthest at the centre can run in a continuously curved manner, optionally with the exception of a flattened portion which co-forms the furthest-projecting region. The flattened portion is preferably shown as a straight line in relation to the contour line, which goes over into a contour line running in a continuously curved manner. Preferably the straight line goes over into a continuously curved profile on both sides.

The curvature can also extend as far as the inlet into a flank contour of the rib which extends rectilinearly in the bringing-together direction. For this purpose, in a possible, furthermore also preferred embodiment, the rib can have only two optionally parallel contour lines and the previously described end-face-side curvature with reference to the previously described cross-section, furthermore optionally a flattened portion co-forming the furthest projecting region. Preferably the curved (partial) contour line goes over tangentially into the surface contour.

The pressing jaws described here preferably consists of a metal material, for example, a steel material. They can be configured to be multipart or also one-part. They can be produced by forming, for example, by hot forming but also by primary forming, for example as a casting, in particular in the investment casting method. Furthermore, a sintering method can also be used.

A plier jaw can also have an upper side facing the associated pressing jaw, wherein in the brought-together state of the pressing jaws, the guide protrusion with its surface given in the bringing-together direction leaves a distance from the facing surface of the plier jaw, this preferably also in the completely brought-together state of the pressing jaws. Regardless of the twist position of the pressing jaw pair about the twist axis, a collision-free displacement of a guide protrusion in the direction of the facing upper side of the plier jaw is made possible. Preferably even in the completely brought-together state, a guide protrusion does not go beyond the opposite pressing jaw.

In a further proposed embodiment, a pressing jaw can have a pivot pin which is mounted for pivoting in one of the plier jaws, wherein the pivot pin can be held dismountably in the pressing jaw. According to a preferred embodiment, the pressing jaw can be rotatable about a geometric axis of rotation which passes through the pivot pin. Accordingly, the pivot pin can provide the geometric twist axis.

In one possible embodiment, a twisting of the pressing jaw about the pivot pin can take place in the mounted position of the pressing jaws.

The proposed twistability about the axis of rotation can be achieved continuously, furthermore alternatively however also in a stepwise manner, for example in 15°, 30° or 45° steps when viewed in the circumferential direction.

For example, the pressing jaw can be dismounted from the pivot pin for a change of the pressing jaw, further for example after wear of the pressing jaw or for arrangement of a differently designed pressing jaw adapted to the blank. This can be accomplished without tools, furthermore possible however also using a conventional tool such as, for example pliers or a screwdriver.

The holder of the pivot pin can be formed by a plug-in part which is received positively both on the pivot pin and on the pressing jaw. In order to dismount the pressing jaw from the pivot pin, the plug-in part should accordingly be removed, whereby the form fit is cancelled.

The plug-in part can overall be configured to be approximately U-shaped, accordingly having two U legs which run substantially parallel to one another, which are connected via a U-web. The form fit can be achieved in the region of the U legs and/or the U web.

The plug-in part can also be configured to be resilient, for example, as a result of the formation of the plug-in part as a wire form spring, in particular a U-shaped wire form spring.

In a further embodiment which can also be essential when considered for itself alone, the pivot pin can be received in the associated plier jaw in a rotatable joint for pivoting about a pivot axis running transversely to the twist axis, wherein when the pressing jaw is released from the opposite plier jaw, the pressing jaws can be twisted individually or together for pulling out in the direction of the twist axis from the pliers mouth. With the release of the one pressing jaw from the associated plier jaws or from the associated pivot pin, a spacing of the upper side the plier jaw facing the pressing jaw from the pressing jaw can be achieved accompanied by displacement of the relevant pressing jaw in the direction of the other pressing jaw. This results in a free space between the released pressing jaw and the facing surface of the plier jaw, which can be used for a pivoting of the pressing jaw pair about the pivot axis, further in particular in a direction in which the pressing jaw pair is moved out from the region of a pliers mouth. Accordingly after release of the further pressing jaw from the relevant pivot pin, the pressing jaw pair can be pulled out substantially in the direction along the pivot axis. It is thus possible to change a pressing jaw in a favourable manner in terms of handling technique.

Furthermore, a configuration of a pivot axis and/or a twist axis, as described previously, is also feasible in pressing jaws which have no guide elements or differently shaped guide elements.

In possible pressing jaws the ribs of which have protuberances projecting beyond the ridge line in the direction of the pressing jaw opening, these protuberances can overlap one another when viewed onto a broad side of the ribs in relation to a rib family.

In one possible embodiment, only individual rib families can have such protuberances, thus for example both rib families of a pressing jaw whereas the rib families of the other pressing jaw have no such protuberances. Alternatively, each rib family of each pressing jaw can be provided with such a protuberance. In a further embodiment all the rib families, accordingly all the ribs of both pressing jaws are provided with such protuberances.

According to one possible embodiment, the ridge lines can run continuously, i.e. from one end of the ridge line to the other end of the ridge line stretched rectilinearly in the longitudinal direction of extension. Also such a ridge line can have at least one straight-running region which is further adjoined, for example, by a protuberance.

Furthermore, straight-running regions of the ridge line having different or also the same lengths can also be provided on both sides of the protuberance relative to the longitudinal direction of extension of the ridge line.

These rectilinearly running regions optionally provided on both sides of the protuberance can go over into one another in linear extension so that in a possible, even preferred embodiment, these straight-running regions can run along a geometric base line spanned between the two end points of the ridge line.

A greatest extension of the protuberance over such an imaginary base line in the direction of the pressing jaw opening can correspond to a fiftieth to a tenth of the greatest extension of the base line established when the pressing jaw opening is initially closed.

The initially closed pressing jaw opening is achieved in the pressing jaw displacement position in which the intermeshing ribs of the pressing jaws moved towards one another with their ridge lines completely circumferentially enclose the pressing jaws in their largest cross-sectional shape.

The protuberances of the ribs in a preferred embodiment act in each pressing jaw opening position, accordingly preferably act in a pressing of the most diverse core end sleeve cross-sections.

The length of the protuberance measured in the direction of extension of the base line corresponds to a third to a tenth of the greatest extension of the base line established when the pressing jaw opening is initially closed.

The ridge line can be formed to be circular-section-shaped in the region of the protuberance having continuously the same radius, optionally with a varying radius in the direction of extension.

In one possible embodiment, there is also a highest point of the protuberance, which highest point of the protuberance relative to the greatest extension of an imaginary base line established when the pressing jaw opening is initially closed is offset from a longitudinal centre of the rib. This offset can be achieved as far as a complete eccentric arrangement of the entire protuberance, thus for example during a pressing of core end sleeves having a relatively large cross-section, for example, 16 $mm^2$. During a pressing of core end sleeves having a smaller cross-section, for example 6 $mm^2$ or 2.5 $mm^2$, an arrangement of the protuberance traversed by the longitudinal centre can be obtained at the instant of pressing relative to the then effective ridge line.

The offset is preferably given with respect to the base line of the next-following rib of the same pressing jaw in the adjacent arrangement, which adjoins the base line substantially at right angles to the base line. The longitudinal centre here relates to a centre when the pressing jaw opening is initially closed between the points delimiting the ridge line at the end, accordingly to the imaginary base line.

With regard to the proposed method, this result in a concavity which is configured asymmetrically in relation to a central line aligned perpendicular to an otherwise linearly running ridge base line. The concavely running wall sections of the pressed core end sleeve are obtained accordingly, particularly in the case of larger-diameter cross-sections such as, for example, 16 $mm^2$ or 8 $mm^2$, with reference to a wall leg viewed in cross-section of the otherwise substantially rectangular-shaped wall tendentially assigned to the corner region whereas assigned to the opposite corner region, the relevant wall section preferably runs rectilinearly. In the case of smaller cross-sections, a wall leg can even be established with a concave wall section which is flanked on both sides by straight wall sections of approximately the same length. In the case of the smallest cross-sections, for example, 2.5 $mm^2$, an effect can even be established in which substantially only one concave wall sections connecting the corner regions of the otherwise substantially right-angled wall. In the case of these small cross-sections, it can occur that in the course of the pressing, a complete filling of the pressing contour on both sides of the protuberance does not occur, accordingly no rectilinearly running wall sections are established.

The ranges or value ranges specified hereinbefore and hereinafter also include with regard to the disclosure all the intermediate values, in one-tenth steps of the respective dimension, optionally therefore also dimensionless. For example, the information a fiftieth to a twentieth also includes the disclosure of ten five hundredths to nine two hundredths, eleven five hundredths to ten two hundredths, eleven five hundredths to nine two hundredths etc. This disclosure can be used, on the one hand to impose a lower and/or upper limit of one said range limit but alternatively or additionally for the disclosure of one or more singular values from a respectively specified range.

BRIEF DESCRIPTION OF THE DRAWINGS

The invention is explained hereinafter with reference to the appended drawings which however only show exemplary embodiments. A part which is only explained with reference to one of the exemplary embodiments and in a further embodiment is not replaced by another part as a result of the particular feature established there is therefore also described as a possible part provided in any case for this further exemplary embodiment. In the drawings.

DESCRIPTION OF THE EMBODIMENTS

Figure 1:
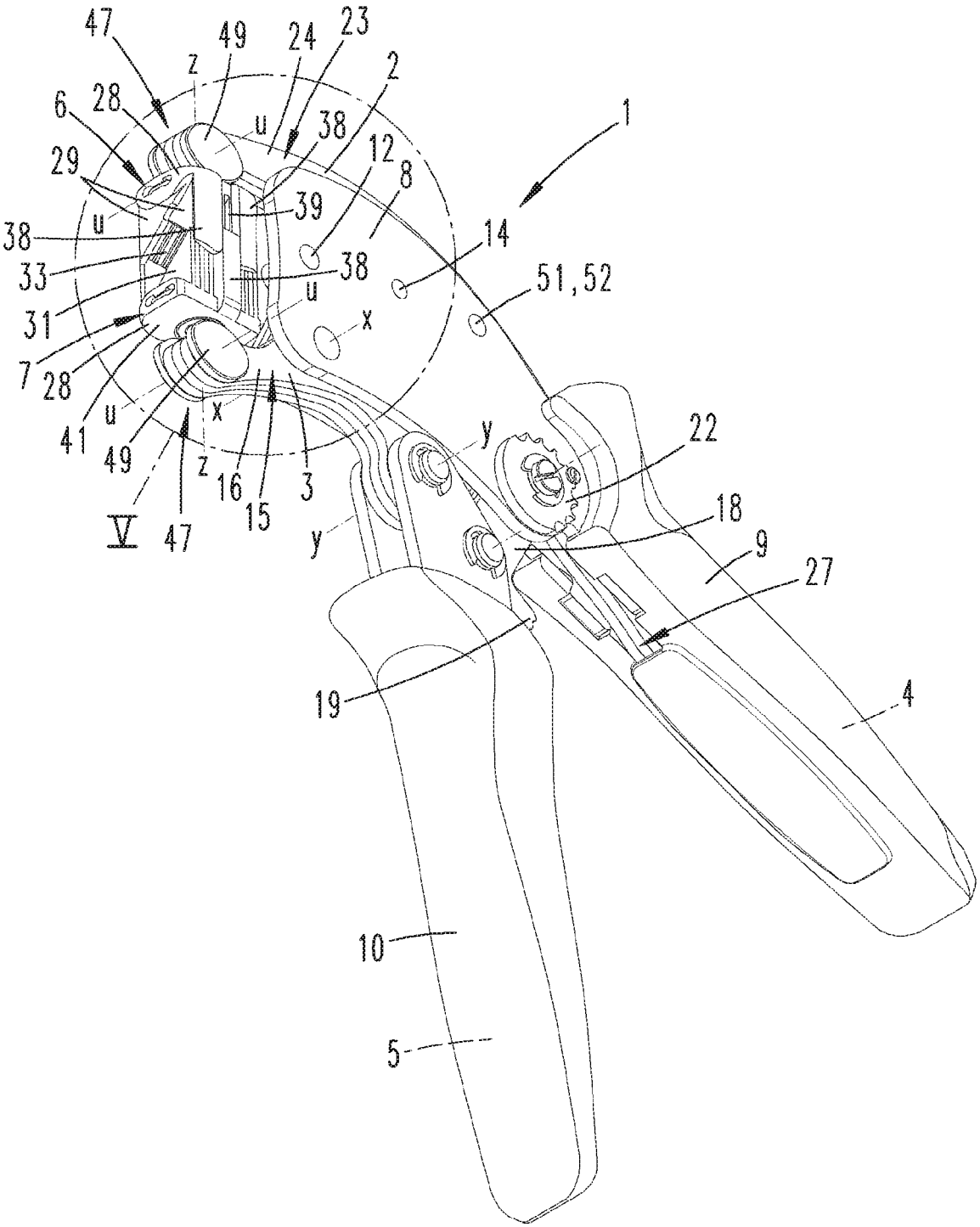
FIG. 1 shows in a perspective detail diagram crimping pliers in a pressing mouth open position.

Shown and described initially with reference to FIG. 1 are crimping pliers 1 which substantially comprise two plier jaws 2, 3, two handle parts 4, 5 and a first pressing jaw 6 and a second pressing jaw 7, which are arranged opposite one another as a pressing jaw pair.

FIGS. 1 to 28 show crimping pliers 1 with pressing jaws 6 and 7 in a first embodiment. A second embodiment of the pressing jaws 6 and 7 is shown in FIGS. 29 to 35.

The plier jaw 2 and the associated handle part 4 are hereinafter further designated in each case as fixed whereas the plier jaw 3 and the handle part 5 associated with this is further designated as movable.

The first pressing jaw 6 is associated with the fixed plier jaw 2 whereas the movable plier jaw 3 carries the second pressing jaw 7.

The fixed plier jaw 2 is substantially composed of two substantially identically configured jaw parts 8 which are spaced apart from one another transversely to the longitudinal extension of the plier jaw 2, which jaw parts go over at the ends into the region facing away from the pressing jaws 6 and 7 into the handle part 4 rigidly connected to the plier jaw 2 thus configured. The handle part can, as is also the case with the moving handle part 5, be embraced by a handle sleeve 9 or 10.

The movable plier jaw 3 is held rotatably about a geometric axis of rotation x on the fixed plier jaw 2 wherein a rotary open position is stop-limited as a result of a support of a stop section 11 of the movable plier jaw 3 on a section of the fixed plier jaw 2, for example, as shown, on a pin 12 extending between the jaw parts 8 of the fixed plier jaw 2 in the direction of extension of the axis of rotation x.

The axis of rotation x runs substantially transversely directed to the longitudinal direction of extension in particular of the fixed plier jaw 2 and the adjoining handle part 4.

Furthermore the movable plier jaw 3 is acted upon by a spring in the direction of its stop-limited rotary open position. For this purpose, in the exemplary embodiment shown, a spring 13, preferably as shown in the form of a cylinder tension spring, which acts on a lever end of the movable plier jaw 3 facing away from the associated second pressing jaw 7. The end of the spring 13 facing away from the plier jaw 3 is connected to a further pin 14 of the fixed plier jaw 2.

Lever sections facing away from one another extend substantially starting from the geometric axis of rotation x, thus a lever section projecting substantially in the direction of the handle part 5, at the end of which the spring 13 acts and a lever section facing away from the handle part 5, directed in a direction of a front side of the crimping pliers 2, on the end region of which the associated second pressing jaw 7 is held.

Overall the movable plier jaw 3 in the depicted exemplary embodiment is preferably formed by a continuously material-uniform plate-like lever part 15.

Furthermore, the movable handle part 5 is substantially articulated at the end of the lever section 17 upon which the spring 13 acts. The relevant geometric axis of rotation y extends in parallel alignment to the geometric axis of rotation x of the movable plier jaw 3. Combined with a ratchet arm 18, this results in a knee joint arrangement K relating to the articulation of the handle part 5 and the action via the handle part 5 on the plier jaw 3.

For this purpose at one end the ratchet arm 18 is articulated to the fixed plier jaw 2 and at the other end, to the movable handle part 5. The relevant geometric axes of rotation each run parallel to the geometric axis of rotation x, and also to the geometric axis of rotation y.

A toothed ratchet section 19 is formed on the ratchet arm 18 for cooperation with a pivotably articulated pawl 20 on the movable handle part 5 upon actuation of the crimping pliers 1. Said pawl is spring-pre-tensioned into the base position as a result of the arrangement of a tension spring 21 in the movable handle part 5.

In a known manner, an adjustment of the knee joint arrangement K is made possible by an actuator 22 which is accessible from outside on the fixed plier jaw 2 and which is rotatable about the geometric axis of rotation about which the ratchet arm 18 is also movable in the region of the fixed plier jaw 2, which actuator can be fixed in a latched manner in several rotational positions. The actuator 22 acts on the fixed-jaw-side of the axis of rotation of the ratchet arm 18 via an eccentric not shown so that by this means a corresponding linear displacement of the relevant geometric axis of rotation can be achieved.

The first pressing jaw 6 is fixed at the end of a resilient retainer part 23. With regard to a central line a of the retainer part 23 running substantially in the longitudinal extension of the fixed plier jaw 2 and its extension into the fixed handle part 4, when viewed from the movable plier jaw 3 or the movable handle part 5, a substantially concave profile is obtained, in particular in the region of a retainer part section 24 between the free end holding the first pressing jaw 6 and a stop connection 25 described in more detail hereinafter.

The retainer part 23 is preferably flanked on both sides by the jaw parts 8 of the fixed plier jaw 2, wherein the retainer part section 26 facing away from the end carrying the first pressing jaw 6 is connected at the end to the fixed plier jaw 2, accordingly to the jaw parts 8 and/or the fixed handle part 4. In the depicted exemplary embodiment a fixed connection 27 is given in this respect by two pin connections spaced apart from one another in the direction of extension of the central line a.

The pressing jaws 6, 7 are configured for opposite arrangement in the crimping pliers 1. One or two pressing jaws 6, 7 have ribs 29, 31. The ribs 29, 31 according to a profile of their free ends projected on to a base surface have a rib longitudinal direction R, cf. for example, FIG. 11. During a pressing, the ribs 29, 31 can move into one another, usually over a part of their height H, cf. also FIG. 11. On this matter, reference is also made to FIGS. 6, 7. The region of the ribs 29, 31 which usually comes into engagement with a blank during pressing is designated as working region. Outside the working region of the ribs 29, 31, the ribs 29, 31 have a guide surface F which cooperates with a guide projection 38 starting from the opposite pressing jaw 6, 7. There is therefore a cooperation and therefore also a displacement hindrance or displacement limitation in the rib longitudinal direction. Additionally or alternatively, the guide surface can also be given for this purpose in the transverse direction. In the depicted exemplary embodiment, this is achieved by a corresponding front face S pointing in this direction, possibly opposite on both sides, of a guide projection 38, cf. also on this matter FIG. 5. The guide surface optionally given in the transverse direction serves less as a displacement limitation and more as possibly an additional guide in the sense of a linear guide of the pressing jaws with respect to one another. A relevant displacement limitation is preferably already achieved by the intermeshing ribs.

The pressing jaws 6 and 7 are preferably of the same design, in this case further preferably comprising firstly a base body 28 on which the ribs 29 are arranged, initially with reference to the pressing jaw 6. The ribs 29 and the base body 28 are, as preferred, formed in one piece of the same material.

The ribs 29 of the pressing jaw 6 have the rib longitudinal direction R. With reference to a viewing direction given perpendicular to this rib longitudinal direction R, substantially triangular ribs 29 are obtained in outline, having an outer rib front face 30 running substantially perpendicular to the base body 28 or perpendicular to the rib longitudinal direction R. Starting from this rib front face 30, the front face facing the opposite pressing jaw, which extends in the rib longitudinal direction R decreases in the direction of the base body 28.

Aligned ribs of a pressing jaw 6 or 7 are arranged spaced apart from one another transversely to the rib longitudinal direction R, in particular with a spacing which substantially corresponds to the rib thickness viewed in the spacing direction.

Partially further ribs of the same pressing jaw 6 or 7 dip into these spacing regions of a pressing jaw 6 or 7. With reference to a front view of the pressing jaw 6 in which front view the triangular outline form of the rib 29 is shown, the further ribs 29 engaging in the intermediate spaces of the previously described ribs 29 are arranged substantially as a mirror-image but preferably offset by a rib width, also accordingly having an outer rib front face 30 running substantially vertically to the base body 28, which lie opposite to the rib front faces 30 of the previously described ribs 29. These further ribs 29 also decrease in the rib longitudinal direction in the direction of the base body 28. Aligned ribs 29 of a pressing jaw 6 form a rib family 54 or 55 (cf. FIG. 8).

The opposite pressing jaw 7 has the same design with regard to the configuration and arrangement of the ribs, accordingly comprising triangular ribs 31 with outer rib front faces 32 when viewed with reference to an outline observed from the front side.

The ribs 29 and 31 of the pressing jaws 6 and 7 intermesh in a comb-like manner, wherein as a result of the previously described triangular outline shape of the ribs 29 and 31 and the mirror-image arrangement inside a pressing jaw 6 and 7 regardless of the spacing of the pressing jaws 6 and 7 with respect to one another, as can be seen in FIG. 1, a pressing jaw opening 33 having a preferably quadrangular, further preferably square outline is established. The edge length of the pressing jaw opening 33 is uniformly variable in the course of a varying linear spacing of the pressing jaws 6 and 7 with respect to one another.

Figure 7:
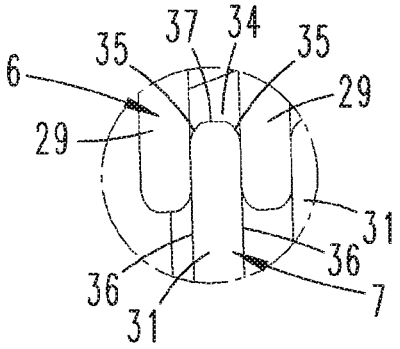
FIG. 7 shows an enlargement of the region VII in FIG. 6.
Figure 9:
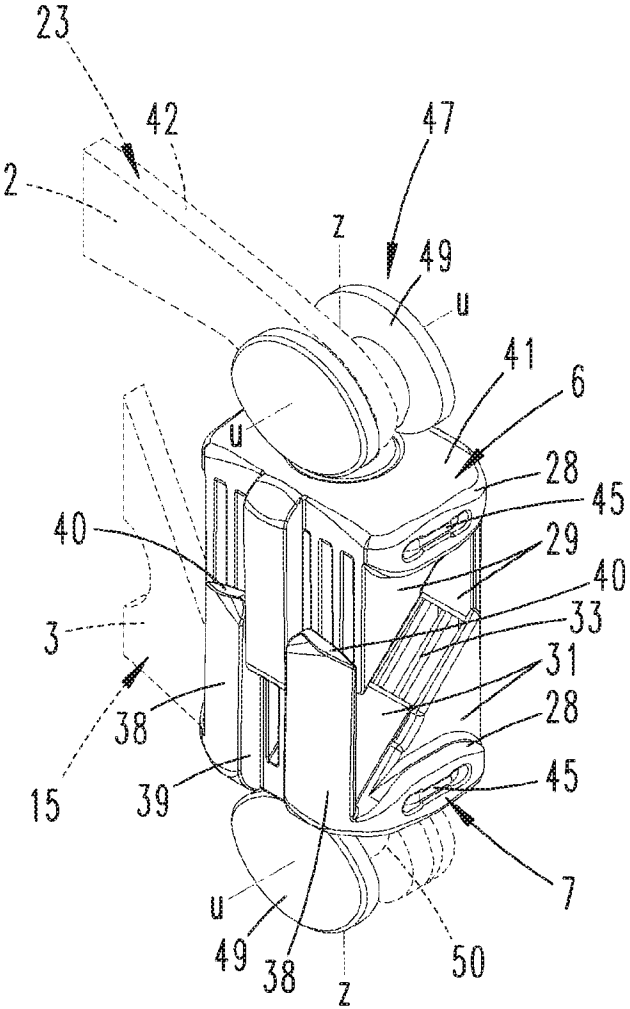
FIG. 9 shows a further perspective diagram of the pressing jaw arrangement viewed in the direction of the arrow IX in FIG. 8.
Figure 8:
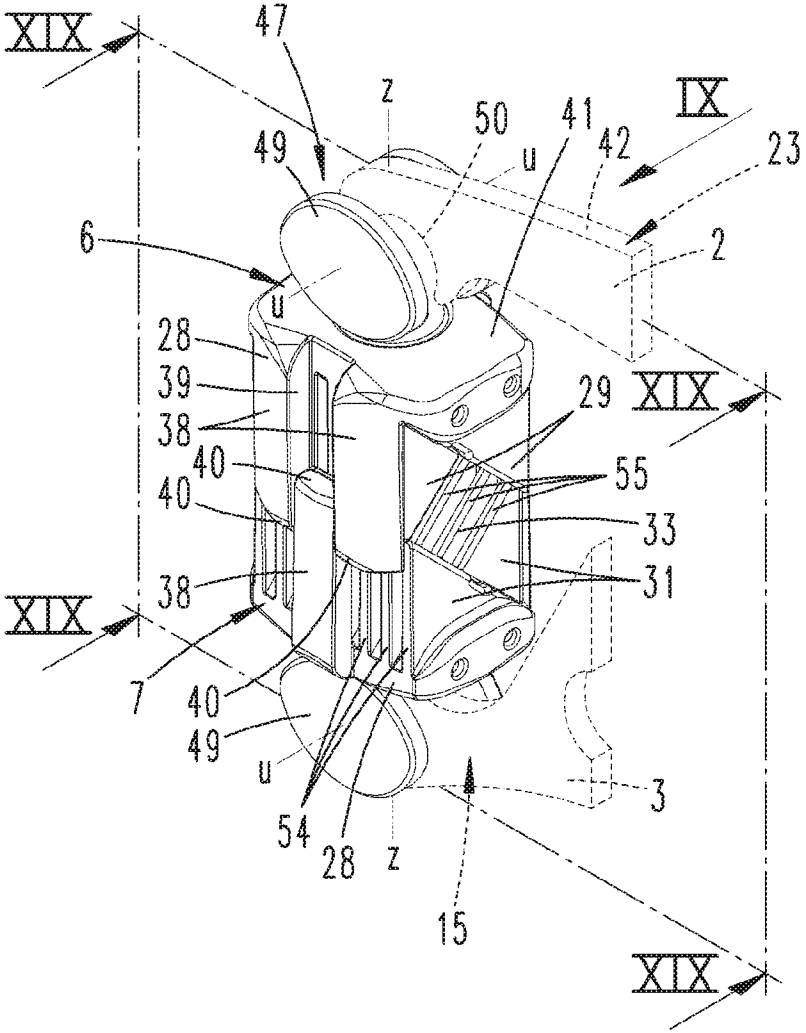
FIG. 8 shows in perspective detailed view the pressing haw arrangement relating to the pressing jaw open position.
Figure 10:
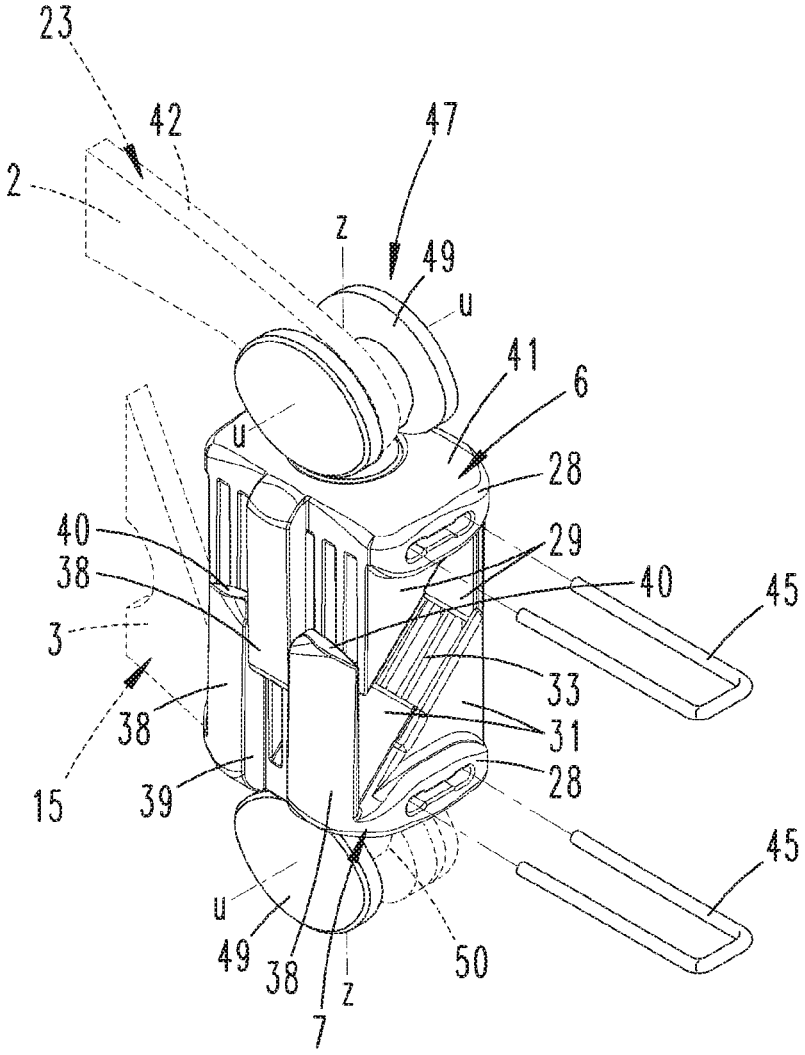
FIG. 10 shows a diagram corresponding to FIG. 9 but after removing plug-in parts which fix the pressing jaws on the crimping pliers.
Figure 11:
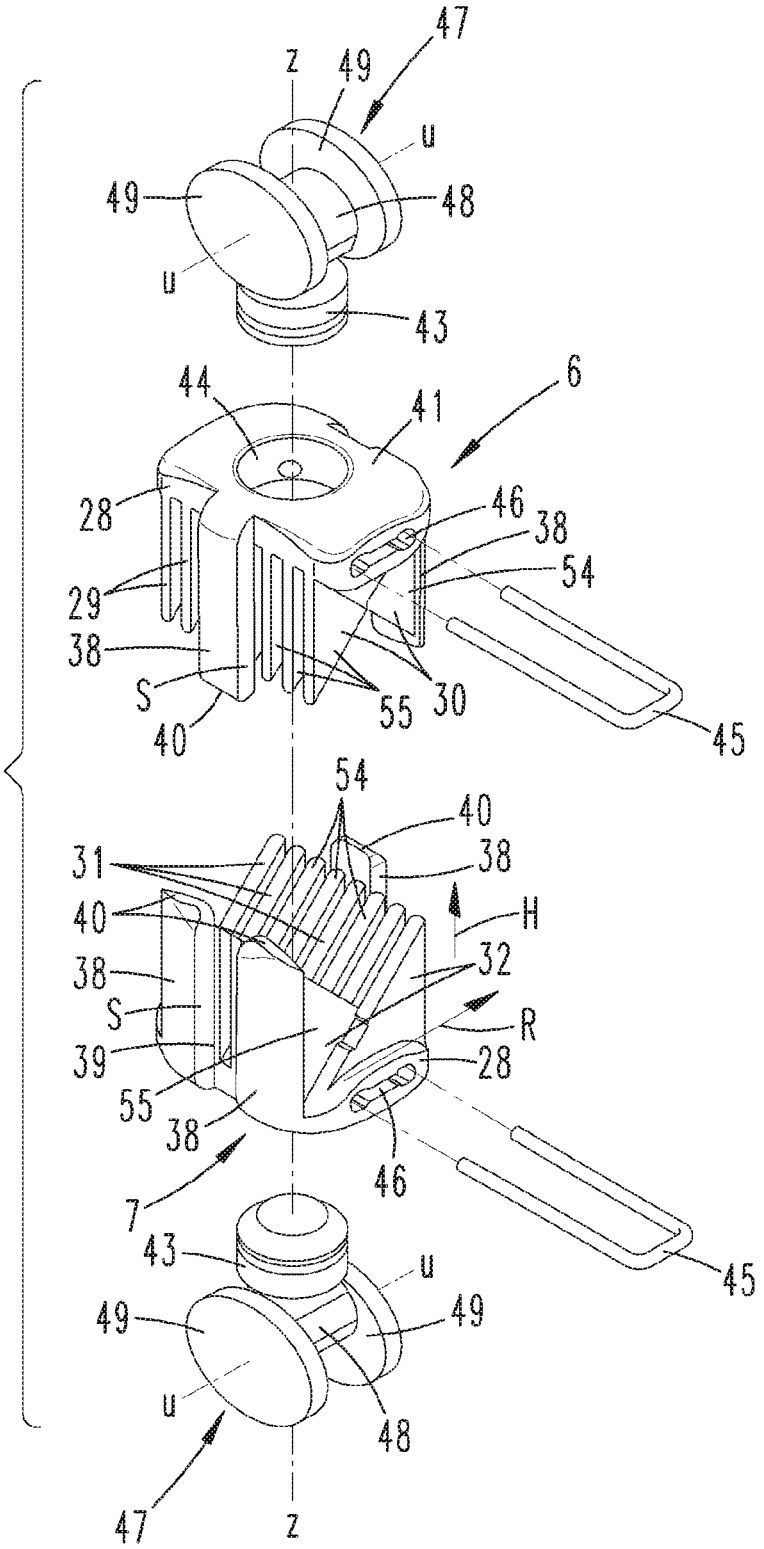
FIG. 11 shows the pressing jaws with associated pivot pin and plug-in parts in a perspective exploded diagram.
Figure 13:
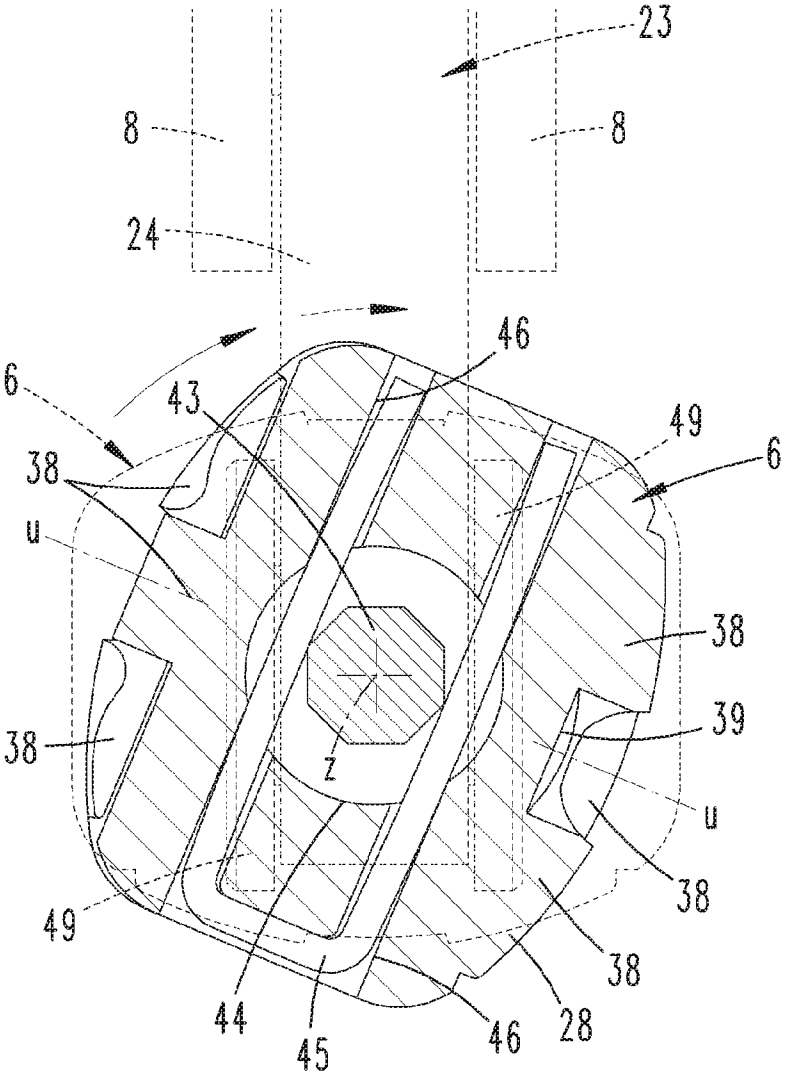
FIG. 13 shows a diagram corresponding to FIG. 12 but in the course of a joint twisting of the pressing jaw pair.
Figure 12:
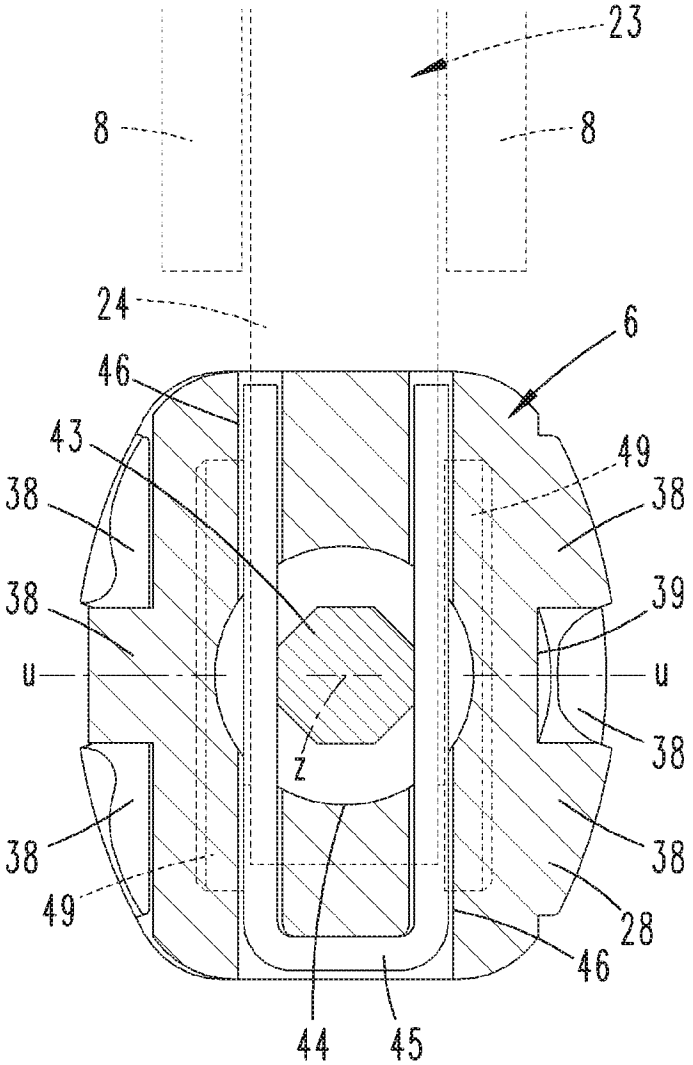
FIG. 12 shows the section according to the line XII-XII in FIG. 4 through the pressing jaw arrangement.
Figure 14:
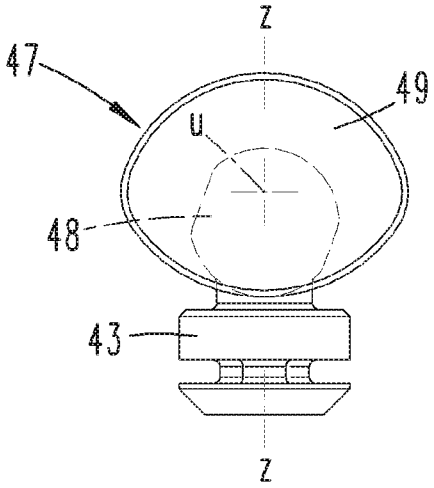
FIG. 14 shows in a detailed diagram a pivot pin configured for holding a pressing jaw.

Facing the other pressing jaw, each rib 29, 31 has a free front face 34 having a rounded contour line 35 in cross-section according to the diagram in FIG. 7, which is obtained transversely to the rib longitudinal direction and which projects furthest at the centre. This rounded or curved contour line 35 extends between the flank contour 36 of the rib 29, 31 which preferably extends rectilinearly with reference to a bringing-together direction r of the pressing jaws 6 and 7, wherein furthermore a parallel-running flank contour 36 is preferably provided on both sides with regard to a rib 29, 31. When viewed in the direction of the opposite pressing jaw, preferably an overall concavely curved contour line 35 is obtained.

The curved contour line 35 can extend continuously over the entire rib thickness observed transversely to the rib longitudinal direction, in this case, for example, having a (uniform) radius of curvature which can correspond to half the rib thickness dimension.

As shown further, the continuous curvature of the contour line 35 can optionally be interrupted by a flattened portion 37 which is approximately central in relation to the cross-section and which co-forms the furthest-projecting region of the rib 29, 31. This can be aligned in relation to the cross-section and optionally run rectilinearly to the flank contour 36.

With reference to a view perpendicular to the bringing-together direction r of the pressing jaws 6 and 7, a ridge line 56 along the front face 34 is obtained in each case when viewed onto the rib front face 30 or 32. In the first exemplary embodiment shown in FIGS. 1 to 28, this ridge line 56 is preferably stretched continuously rectilinearly (cf. FIG. 4).

Transversely to the rib longitudinal direction, upon actuation of the crimping pliers 1, in particular in the course of pressing to be carried out, a support of the ribs 29 and 31 and therefore accordingly a guidance of the pressing jaws 6 and 7 can be obtained.

Further provided is a guide in particular in the rib longitudinal direction. To this end, each pressing jaw 6, 7 has at least one guide projection 38 connected to the respective base body, having a length observed in the bringing-together direction r which can substantially correspond to the length observed in the same direction of the ribs 29 or 31 arranged on the same base body 28. The guide protrusion 38 extends transversely directed to the rib longitudinal direction over a dimension which covers the arrangement of two or three ribs 29, 31 in the depicted exemplary embodiment.

The guide protrusion 38 further extends along the associated rib face.

In the usage position of the pressing jaws 6, 7 in which the ribs 29 and 31 intermesh, the guide protrusion 38 cooperates with the rib front faces 30 or 32 forming a guide surface.

Such a support via a guide protrusion 38 is provided opposite when viewed in the rib longitudinal direction, wherein the opposite guide protrusions 38 are provided twice on one side leaving a central insertion opening 39 remaining in between and preferably only once on the opposite side for insertion into the central insertion opening of the other pressing jaw 6, 7.

Also as a result, a guidance is additionally provided as a result of abutment of the longitudinal edge surfaces of the comb-like cooperating guide protrusions 38 of the two pressing jaws.

In order to further improve the crimping pliers 1 in particular in terms of handling technique, the pressing jaws 6 and 7 are rotatable jointly about a twist axis in the usage position grasped between the fixed plier jaw 2 and the movable plier jaw 3, which twist axis is directed in the bringing-together direction r and transversely to the geometric axes of rotation x and y of the movable plier jaw 3 or the movable handle part 5.

Figure 2:
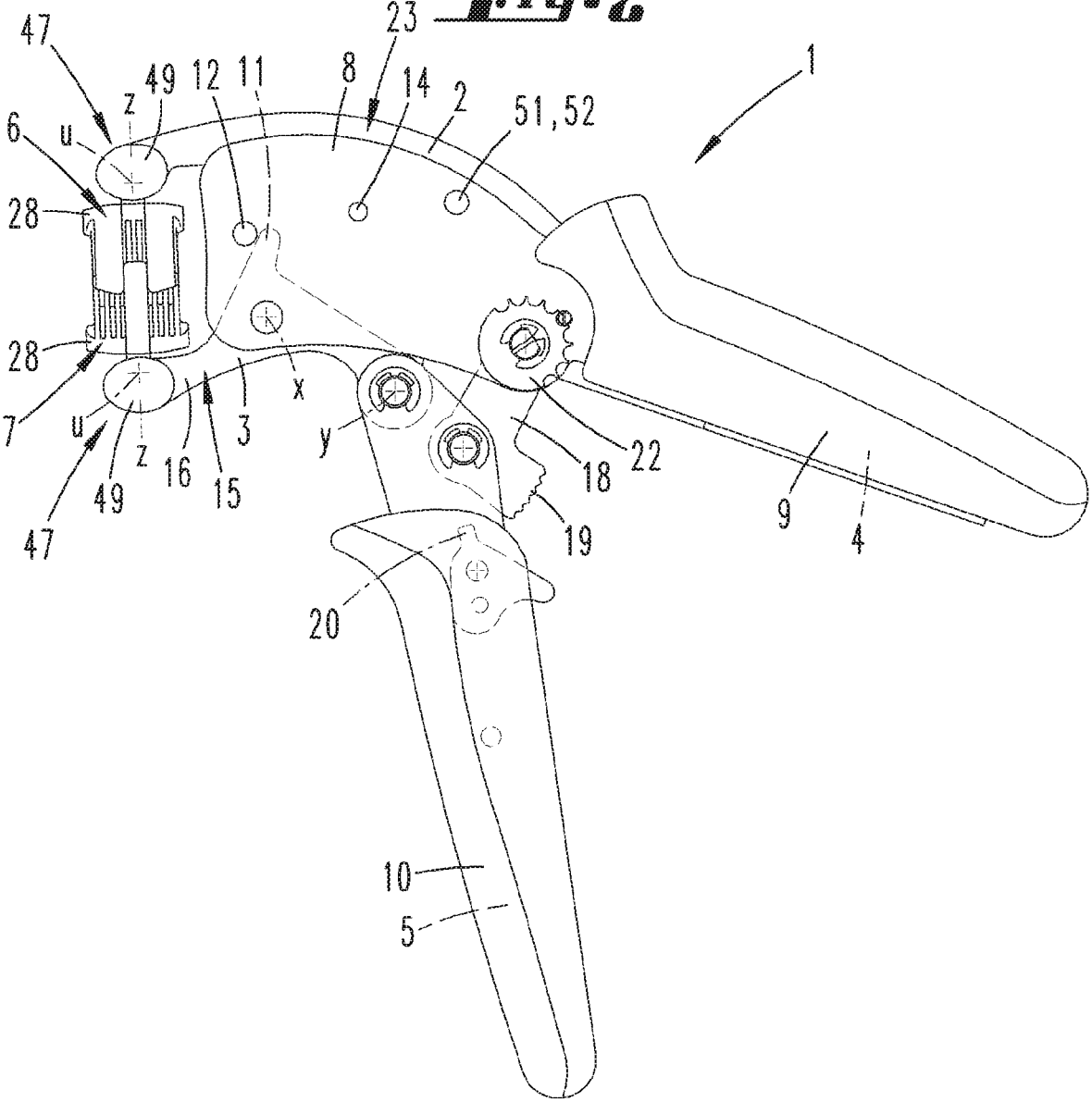
FIG. 2 shows a side view of this.
Figure 3:
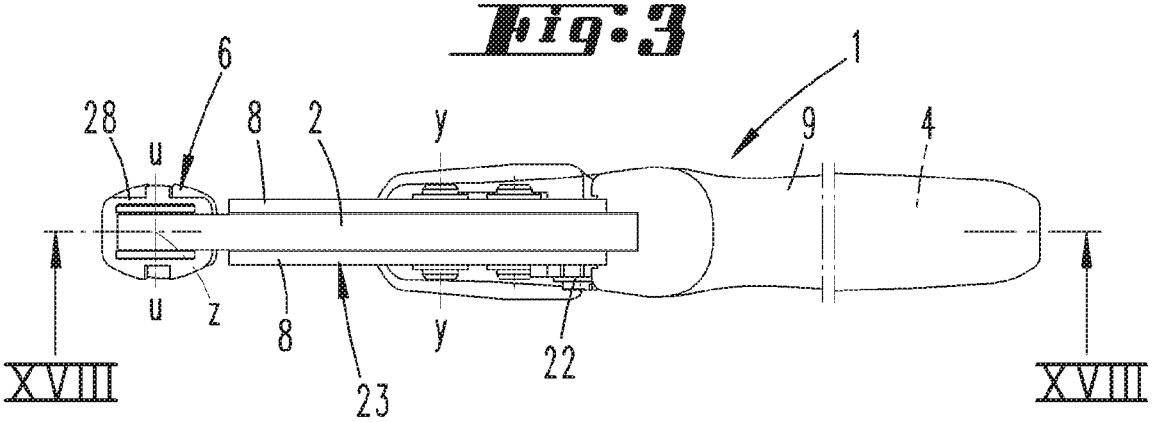
FIG. 3 shows the crimping pliers in plan view.
Figure 4:
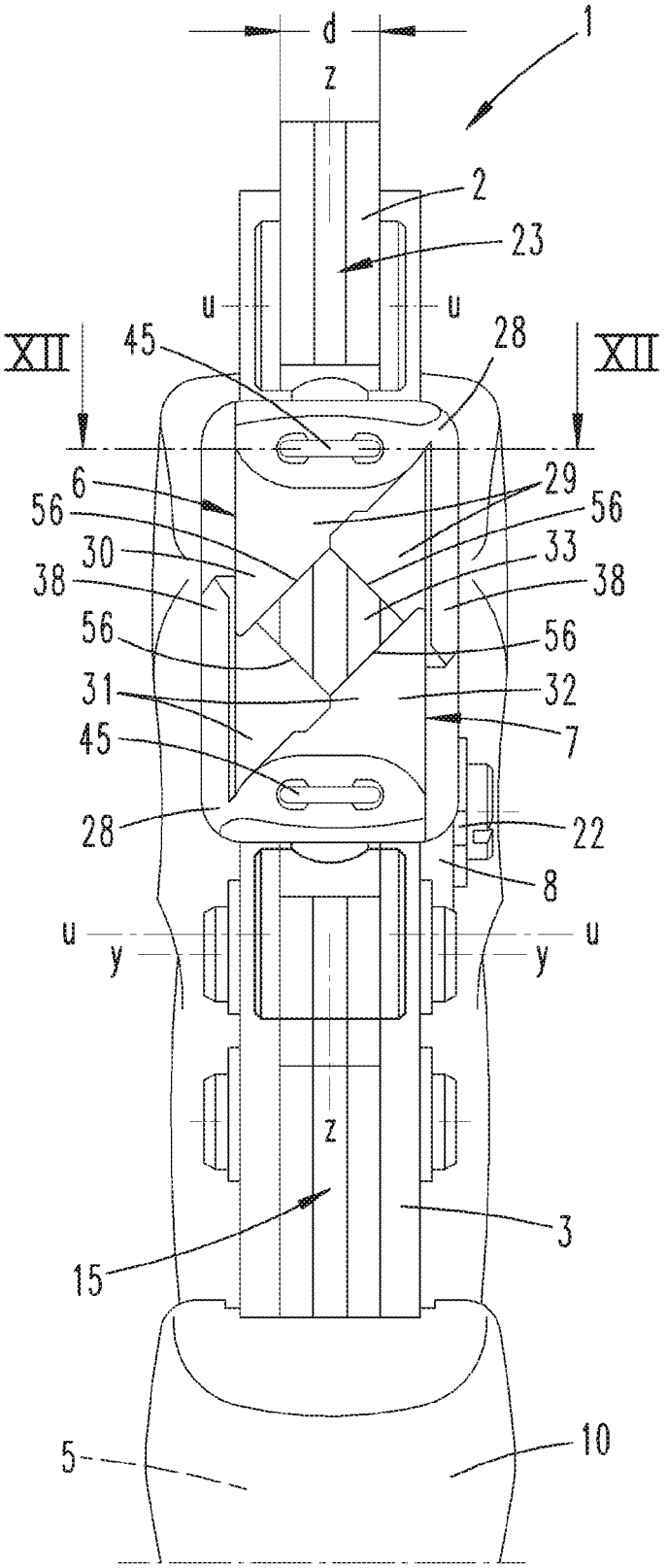
FIG. 4 shows an enlarged front view towards the crimping pliers.
Figure 5:
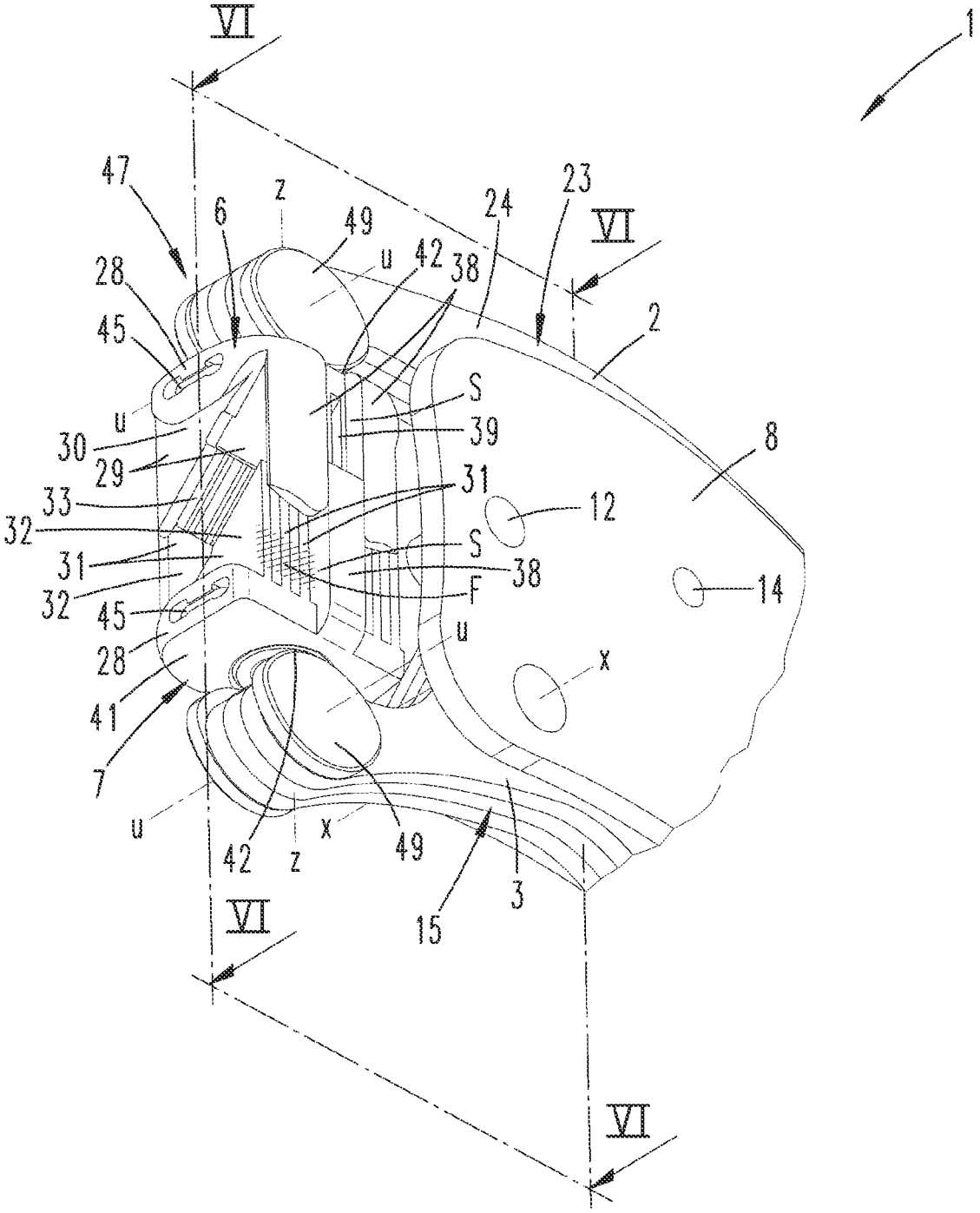
FIG. 5 shows the enlargement of the region V in FIG. 1.
Figure 6:
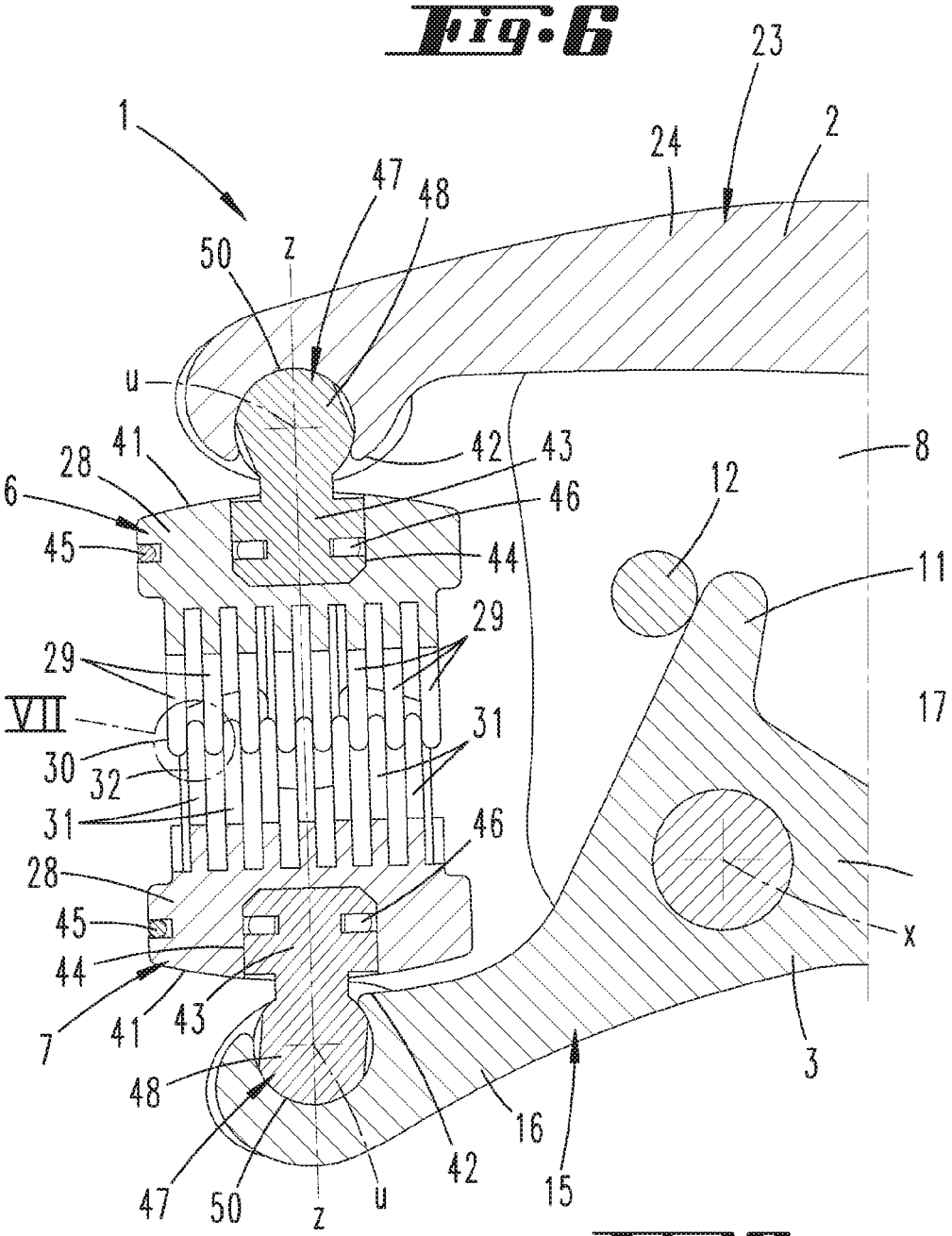
FIG. 6 shows a sectional view according to the plane of intersection VI in FIG. 5.
Figure 28:
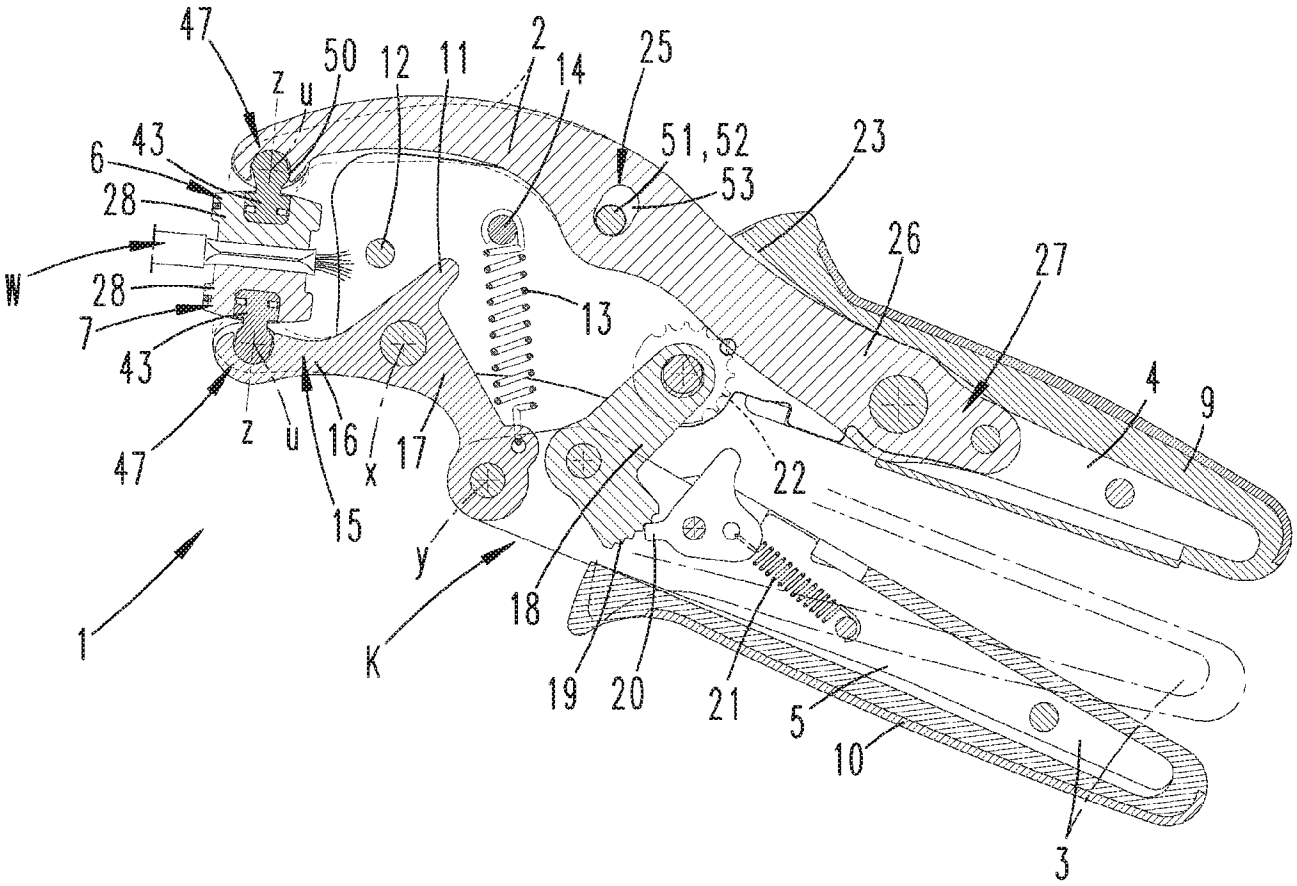
FIG. 28 shows a follow-up diagram to FIG. 26 in the course of the further pressing process during further resilient bending of the retainer part.
Figure 30:
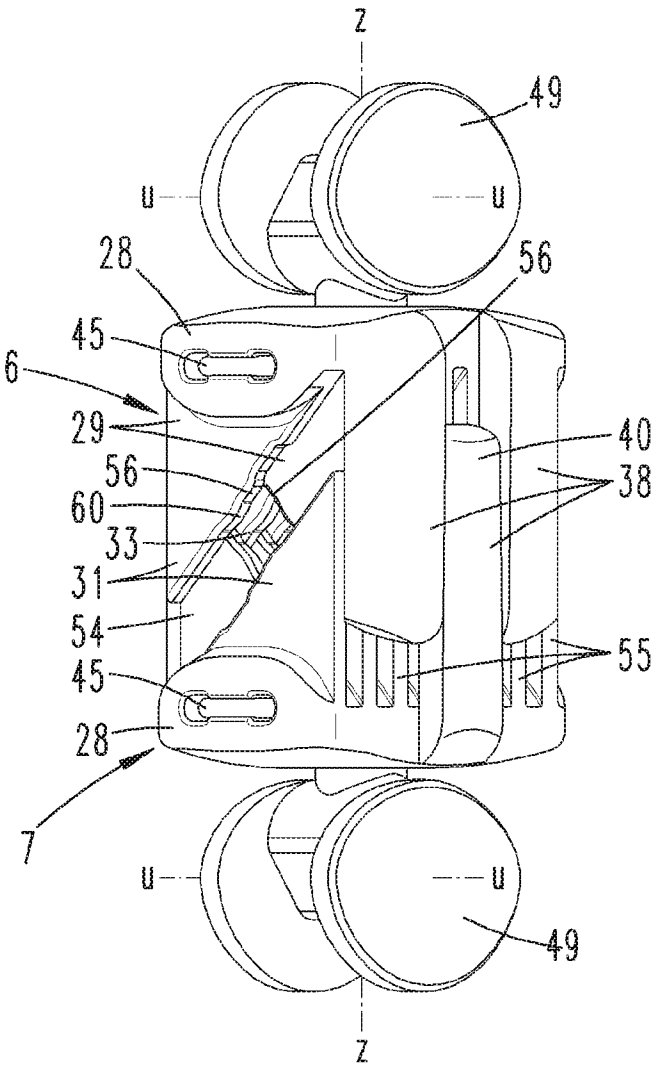
FIG. 30 shows the pressing jaw pair of the embodiment according to FIG. 29 in a perspective diagram.
Figure 29:
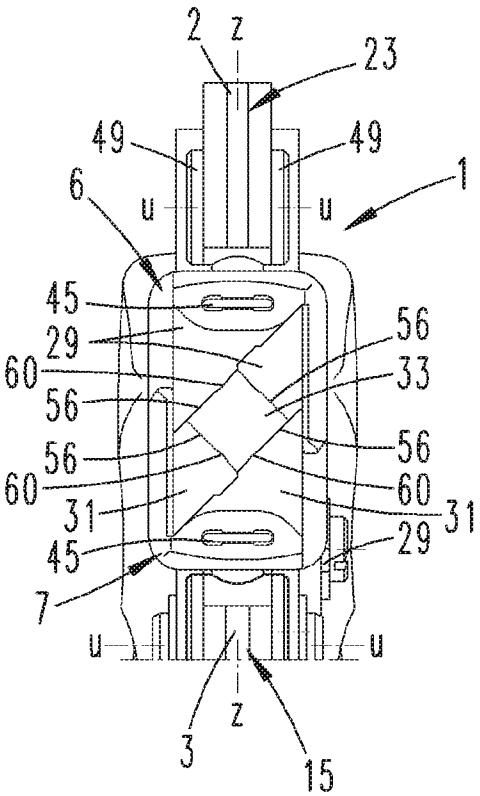
FIG. 29 shows a side view according to FIG. 4 relating to a second embodiment of the pressing jaws.

This possible twisting is independent of the bringing-together position of the pressing jaws 6 and 7, i.e. both in the pressing jaw basic position, for example, according to the diagram in FIG. 2 and further also in a crimping pliers end position, for example, according to the diagram in FIG. 28 and furthermore also in each intermediate position between the basic position and the end position.

This twistability about the twist axis z also in a bringing-together position in which the pressing jaws 6 and 7 are moved completely into one another, which theoretically is only possible when no workpiece to be pressed lies in the pressing jaw opening 33, is substantially achieved whereby the surface 40, facing the opposite plier jaw, of a guide protrusion 3 of the pressing jaw arranged on the opposite plier jaw does not go beyond a lower surface 41 of the base body 28 of the opposite pressing jaw in this bringing-together position. Accordingly, there is always a distance between the surface 40 of the guide protrusion 38 and the facing surface 42 of the plier jaw towards which the guide protrusion 38 approaches.

In order to achieve the twistability, a pivot pin 43 assigned to each pressing jaw 6 or 7 is initially provided. This sits, passing through the lower surface 41, in a shape-adapted recess 44 of the base body 28 of the pressing jaw 6, 7. The pressing jaw 6, 7 is rotatable about the twist axis z relative to the pivot pin 43 whereas the pivot pin 43 is preferably received non-displaceably in relation to the twist axis z in the respectively assigned end of the plier jaw 2, 3 or the lever part 15 or retainer part 23.

The pressing jaw 6 or 7 can be held dismountably on the respective pivot pin 43. For this purpose, in the depicted exemplary embodiment a U-shaped plug-in part 45 is provided which can optionally be plugged in or removed from the front side forming the pressing jaw opening 33 transversely to the twist axis z. For this purpose, two channels 46 running parallel and transversely to the twist axis z are provided in the base body 28 of the pressing jaw 6, 7, through which channels the U-legs of the plug-in part 45 running preferably parallel to one another in the unloaded state can be inserted. The channels 46 thereby traverse the recess 44 substantially receiving the pivot pin 43 (cf. FIG. 11).

The pivot pin 43 can be provided with a polygonal cross-section at least in the section cooperating with the plug-in part 45, in the depicted exemplary embodiment in the form of an octagon. The U-legs of the plug-in part 45 abut against two opposite flat sides of the pivot pin 43 formed as polygonal here with respect to the twist axis z. A positive receipt of the plug-in part 45 both in the pressing jaw 6, 7 and also on the pivot pin 43 is thus given since the previously described polygonal configuration is formed in particular in a constricted-diameter region of the pivot pin 43, accordingly the U-legs lie in the circumferential annular groove thereby formed (cf. also FIG. 6). Accordingly, a rotary latching fixing in several rotational positions can thus be achieved.

By pulling out the plug-in part 45, which in a further embodiment is preferably configured to be resilient, the pressing jaw 6, 7 can be released from the pivot pin 43 to remove the pressing jaw 6, 7.

Each pivot pin 43 can furthermore be fastened via pivot joint 47 to the associated plier jaw 2, 3 or to the associated lever part 15 or retainer part 23. The geometric pivot axis u is transversely directed to the twist axis z, optionally as is also preferred, aligned parallel to the geometric axes of rotation x and y of the movable plier jaw 3 and/or the movable handle part 5.

For this purpose, pivot pin 48 is moulded on the pivot pin 43 in extension of the sections received in the base body 28 of the pressing jaw 6, 7, which pivot pin can be covered on both sides at the end by guide jaws 49 enlarged compared with the pin diameter.

Figure 15:
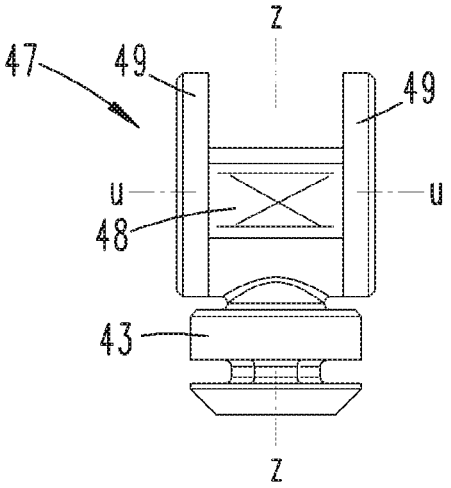
FIG. 15 shows further view of the pivot pin.
Figure 16:
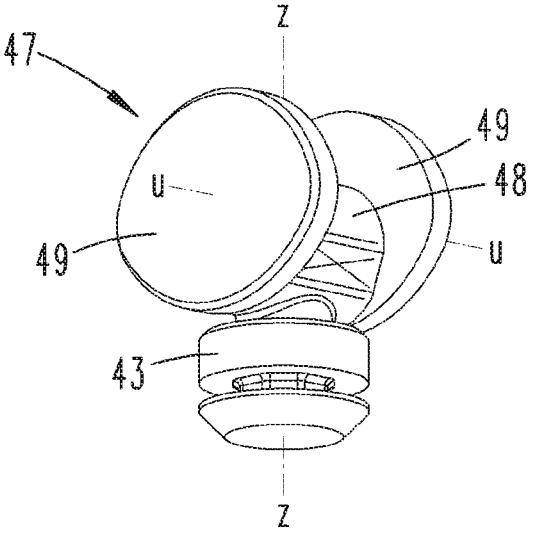
FIG. 16 shows the pivot pin in a perspective diagram.
Figure 17:
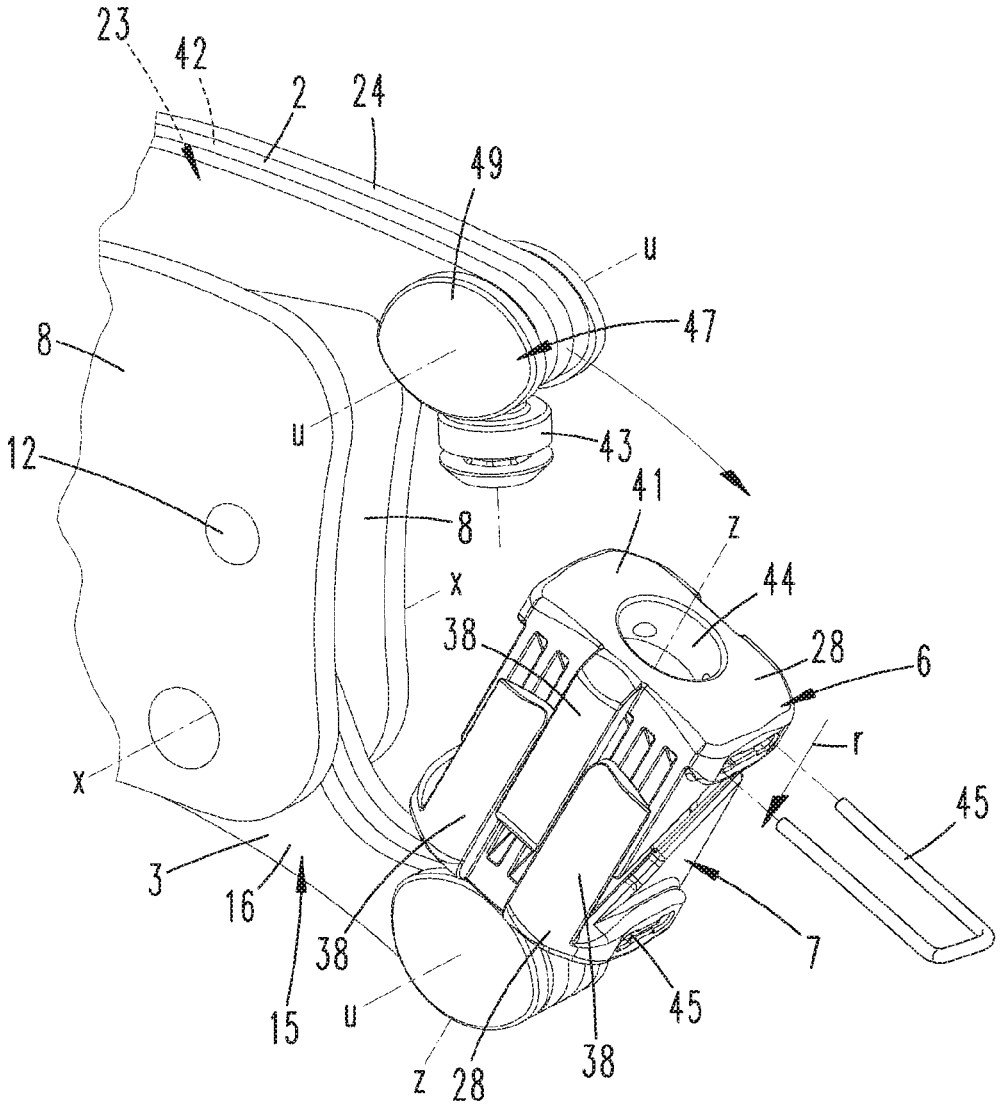
FIG. 17 shows a diagram substantially corresponding to FIG. 9 but after cancelling the holding of a pressing jaw on the appurtenant pivot pin and pivoting away the pressing jaw pair into a removal position.
Figure 18:
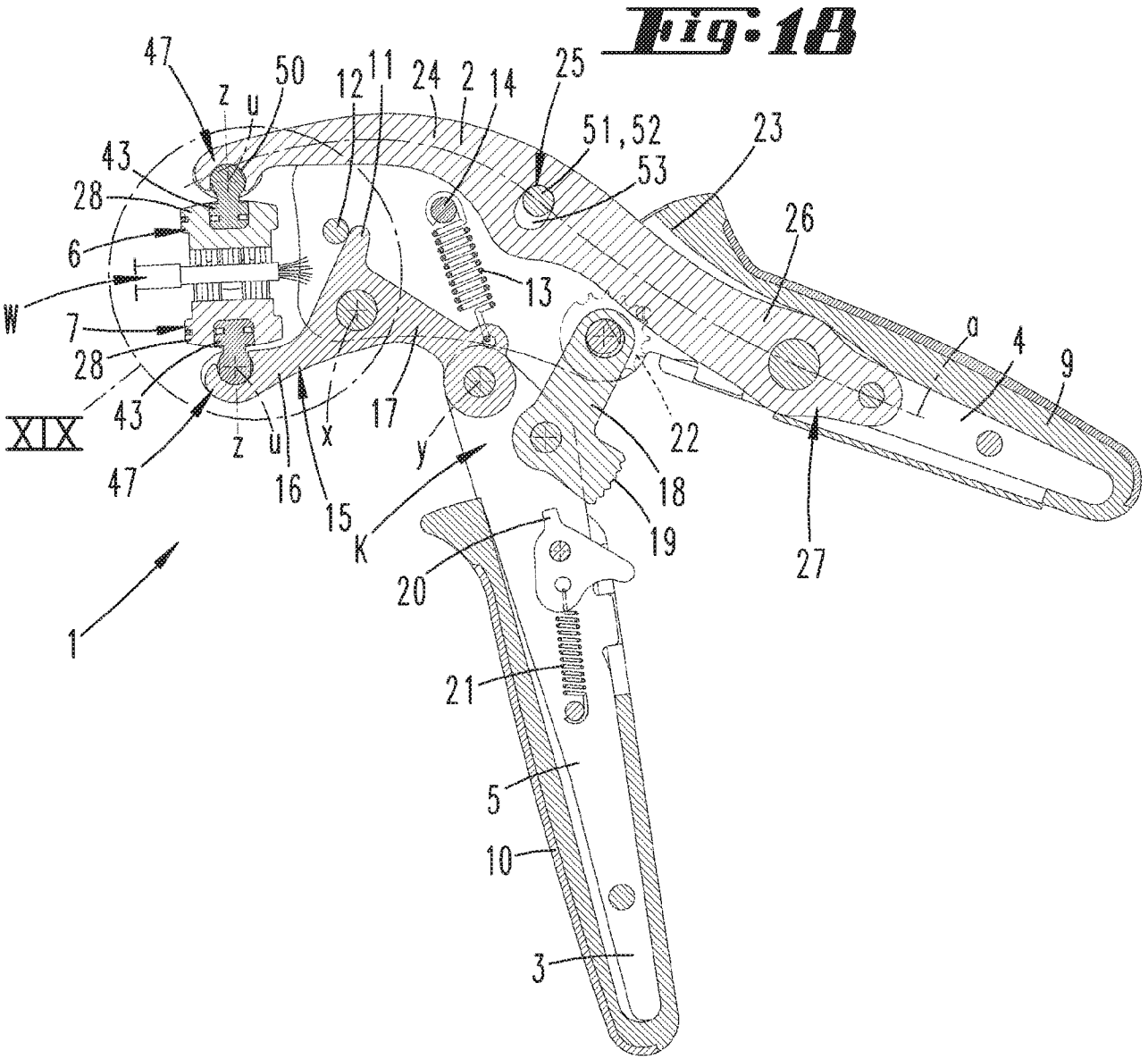
FIG. 18 shows the section according to the line XVIII-XVIII in FIG. 3.
Figure 20:
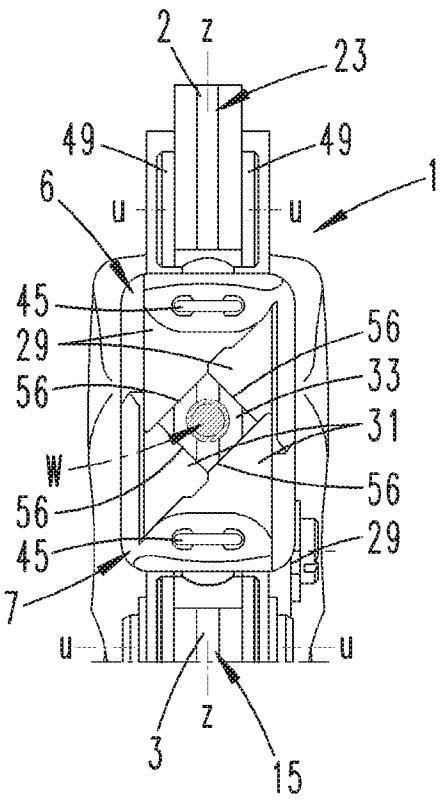
FIG. 20 shows the view according to the arrow XX in FIG. 19.
Figure 19:
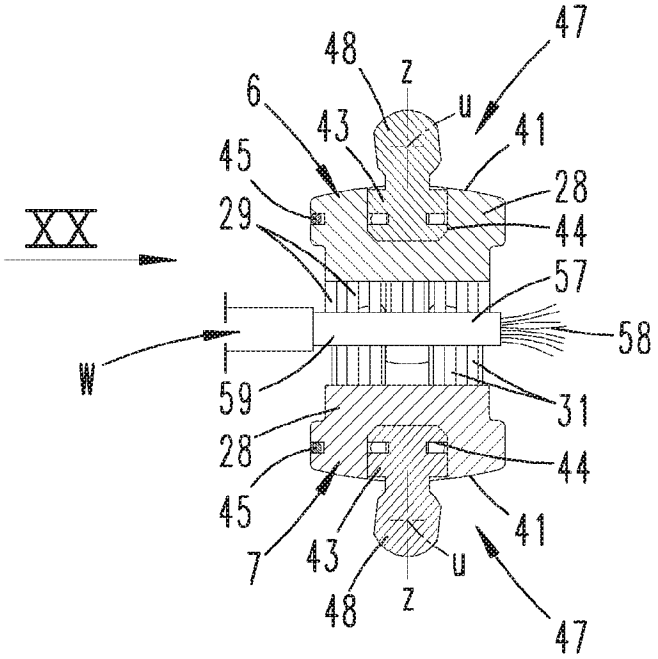
FIG. 19 shows a sectional diagram according to the plane of intersection XIX in FIG. 8 with a workpiece inserted in the pressing mouth relating to a pressing jaw open position.
Figure 21:
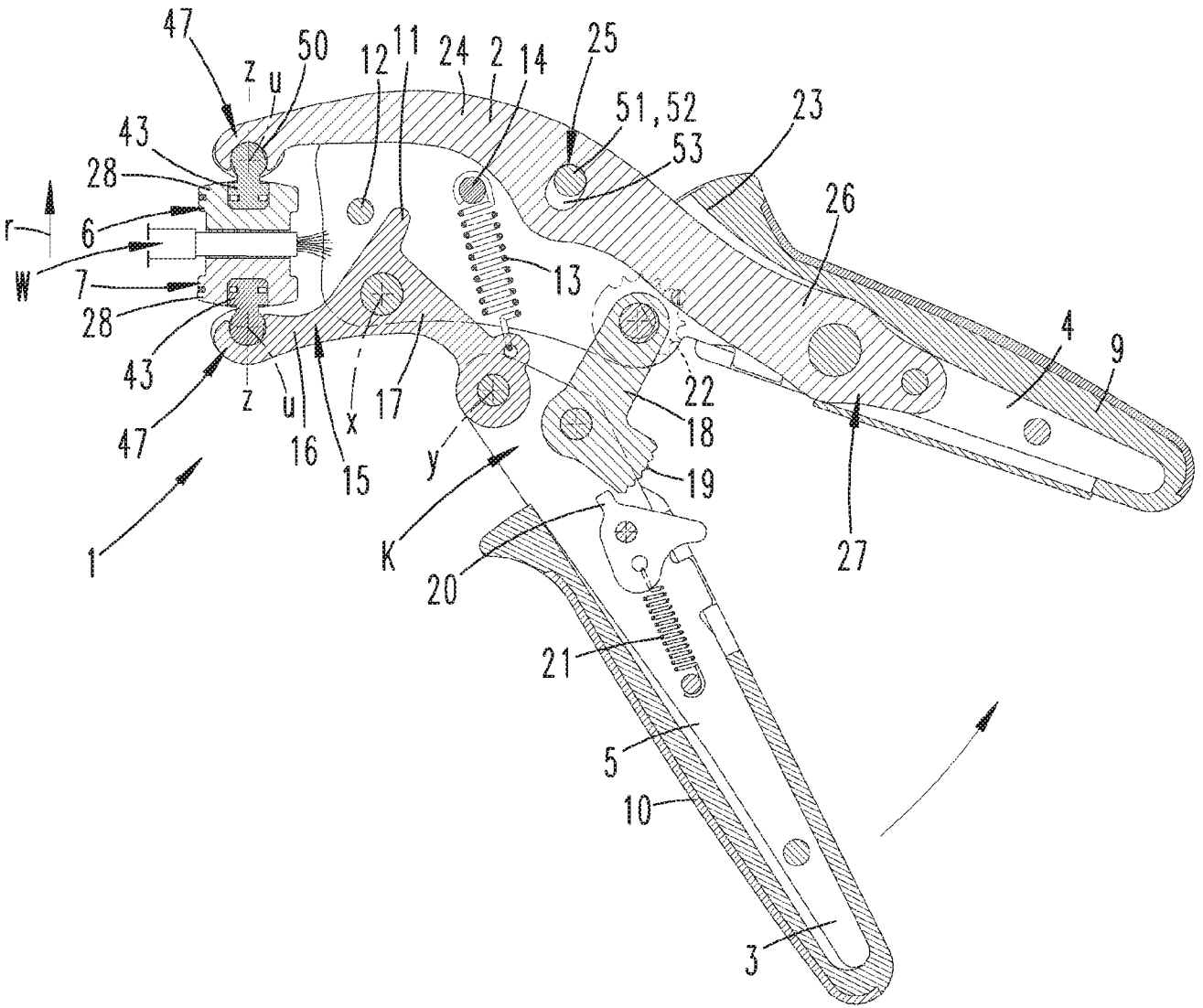
FIG. 21 shows a diagram corresponding to FIG. 18 relating to an intermediate position in the course of a pressing process.
Figure 23:
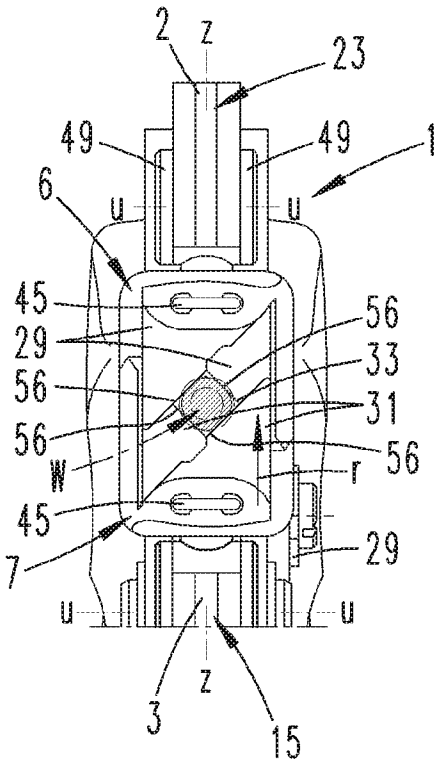
FIG. 23 shows the view according to the arrow XXIII in FIG. 22.
Figure 22:
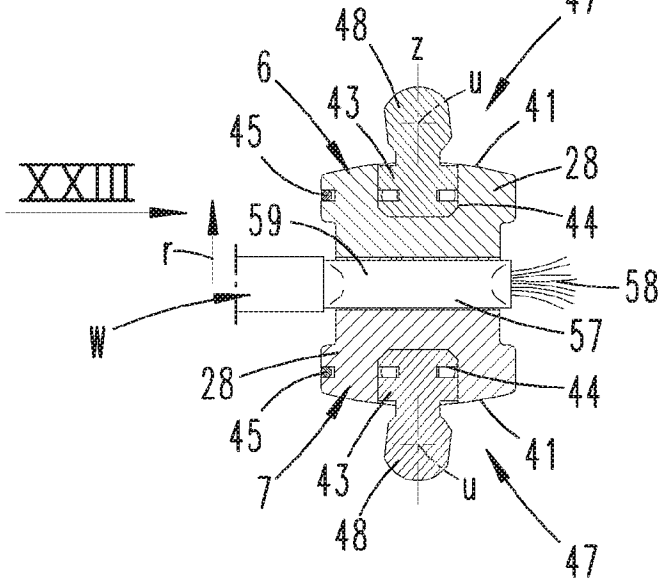
FIG. 22 shows a diagram corresponding to FIG. 19 relating to the pressing intermediate position according to FIG. 21.
Figure 25:
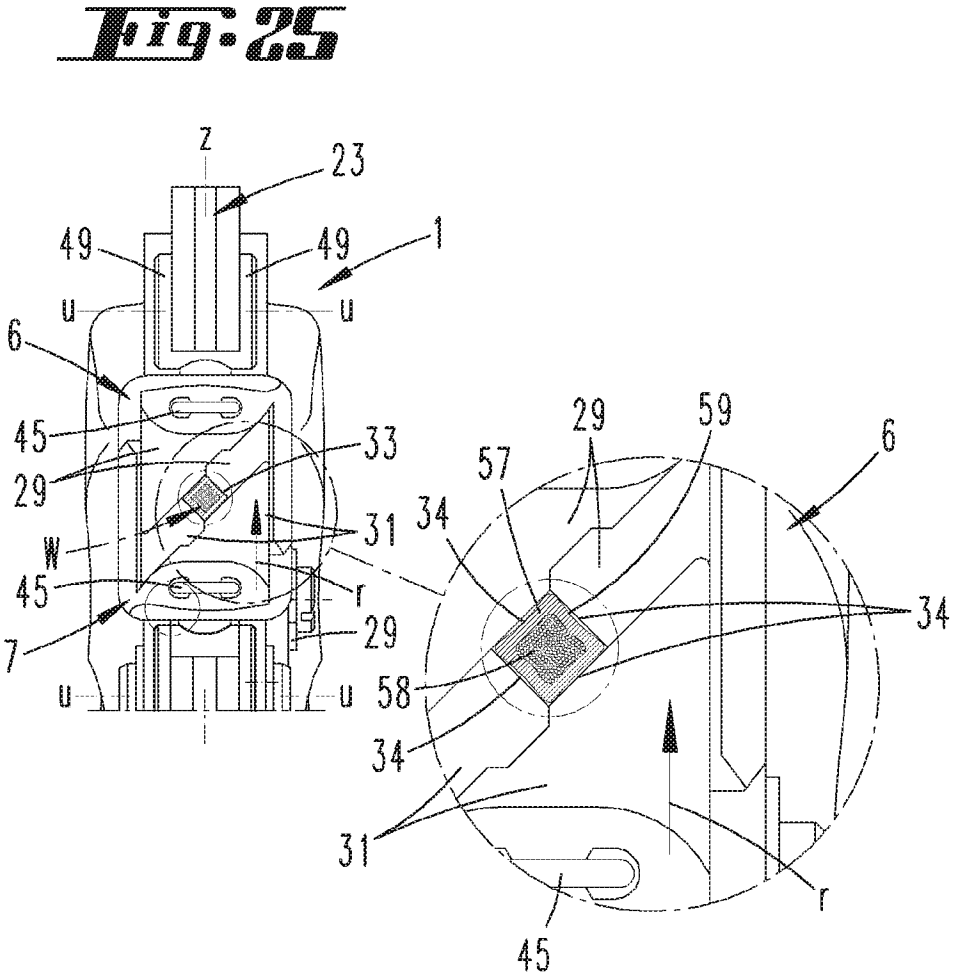
FIG. 25 shows the view according to the arrow XXV in FIG. 24 with a magnifying-glass-like enlarged diagram.
Figure 24:
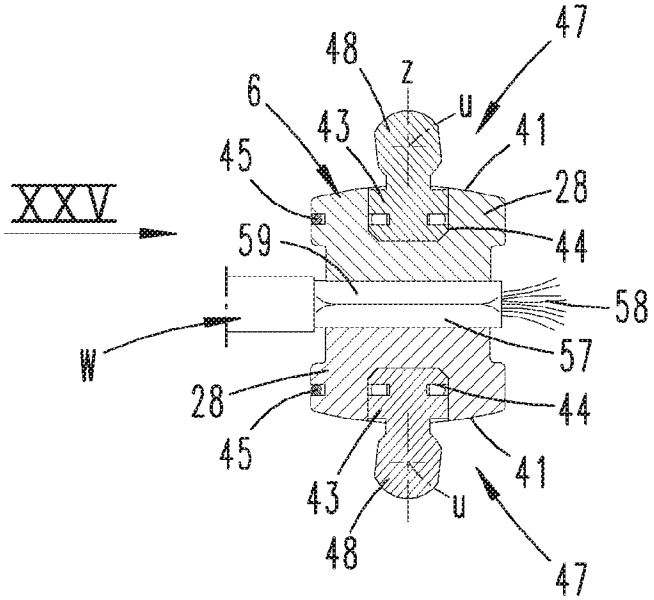
FIG. 24 shows a follow-up diagram to FIG. 22 in the course of a further pressing jaw displacement.
Figure 26:
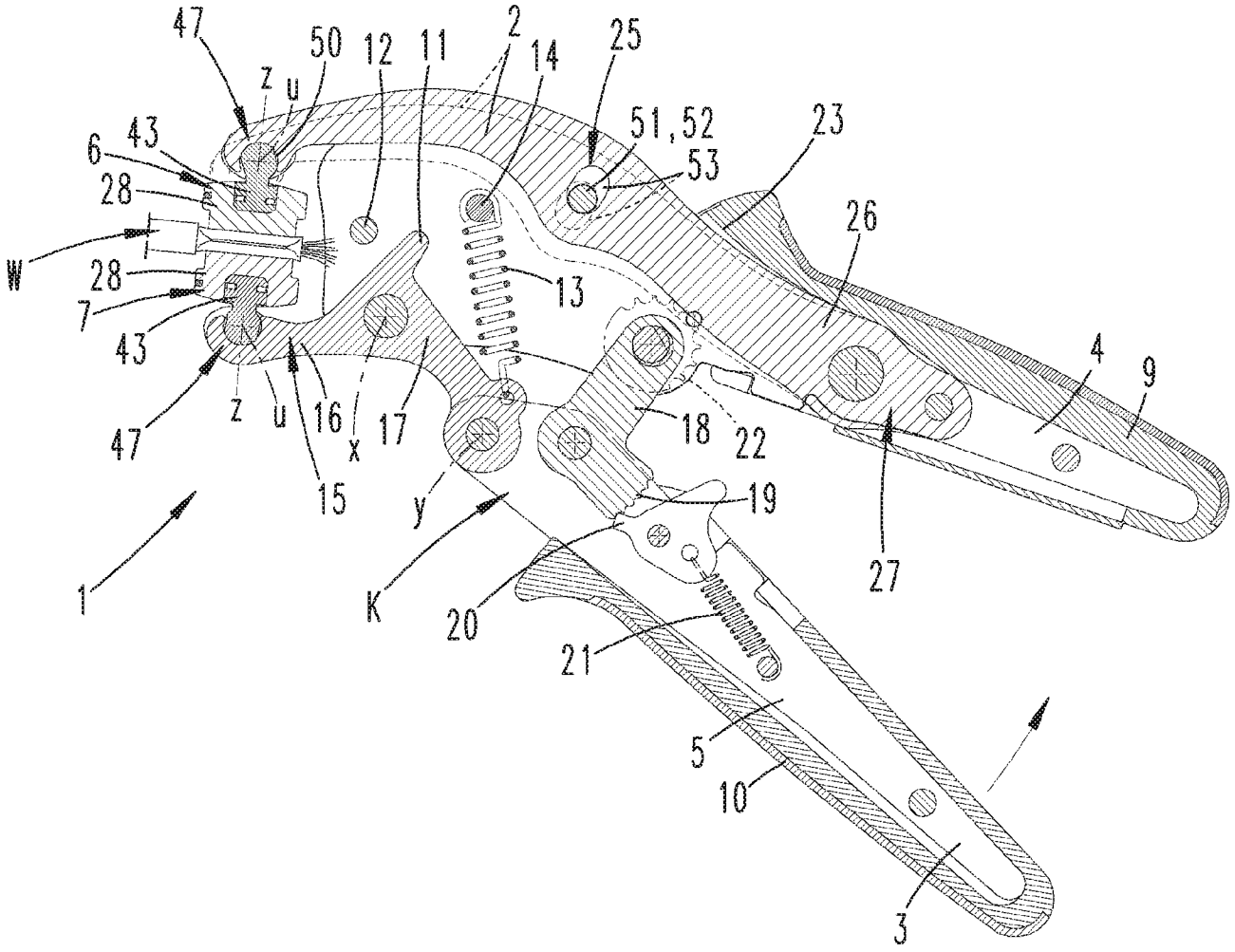
FIG. 26 shows a follow-up diagram to FIG. 21 relating to an intermediate position under a first bending deflection of a retainer part acting on a pressing jaw.
Figure 27:
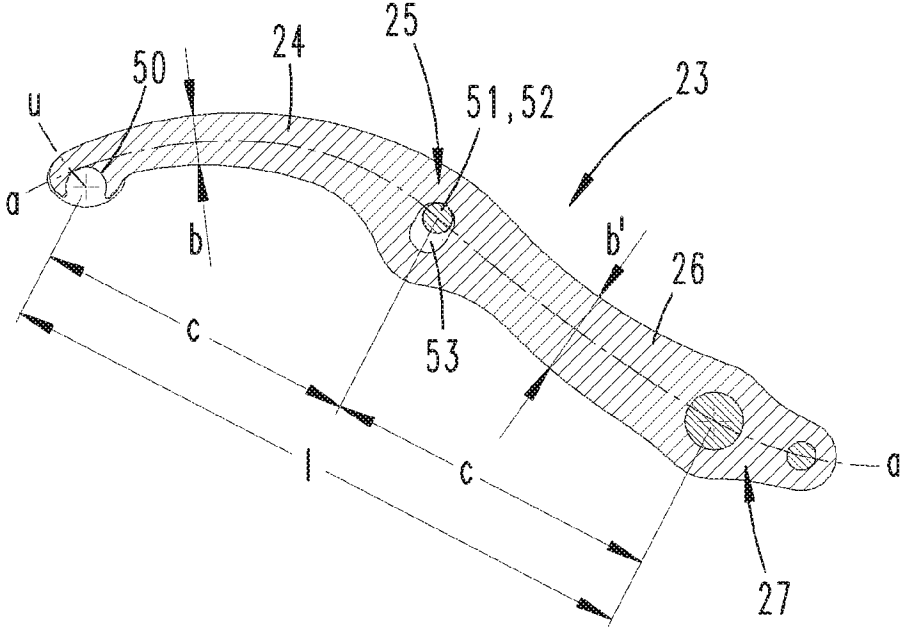
FIG. 27 shows the retainer part in an individual diagram.

The respective pivot pin 48 is received in a shape-matched cavity 50 of the associated plier jaw 2, 3 or the associated lever part 15 or retainer part 23, which cavity 50 preferably extends in the cross-section according to the diagram in FIG. 15 over half the circumferential extension of the pivot pin 48 in order to thus provide a captive holding of the pivot pin 43.

In connection with the previously described pivotability about the pivot axis u given here and the dismountability of the pressing jaws 6, 7 from the respective pivot pin 43, it is possible to remove the pressing jaws 6, 7 in a favourable manner in terms of handling and to equip with these. Thus, for example, for removal firstly the plug-in part 45 of the first pressing jaw 6 associated with the fixed plier jaw 2 can be removed whereafter the first pressing jaw 6 can be displaced in the direction of the bringing-together direction r onto the opposite second pressing jaw 7 with combing interaction of the ribs 29 and 31. The pivot pin 43 thereby leaves the recess 44 whereafter the pressing jaw pair overall can be pivoted forwards about the pivot axis u of the second pressing jaw 7 associated with the movable plier jaw 3, for example, by a pivot angle of about 15° to 30°. In this position, but also already possible previously, the further plug-in part 45 of the second pressing jaw 7 can be removed, after which the pressing jaw pair overall can be removed from the pivot pin 43 of the second pressing jaw 7. The mounting of a pressing jaw pair is accomplished in the reverse order.

Also the second pressing jaw 7 can be initially released from the appurtenant pivot pin 43 and then displaced in the direction of the first pressing jaw 6, after which the pressing jaw pair is pivoted out forwards about the pivot axis u of the first pressing jaw 6, the first pressing jaw 7 is released from the pivot pin 43 and then the pressing jaw thus released is removed.

In the case of one of the plier jaws, the fixed plier jaw 2, the associated pressing jaw 6 is connected to the fixed plier jaw 2 by means of the retainer part 23 already discussed. The retainer part 23 is fundamentally resilient in the sense that it can deviate contrary to the pressing direction in a resilient manner. In the connecting region of the fixed connection during a pressing with the crimping pliers there is none or almost no relative movement between the retainer part 23 and the fixed plier jaw 2.

The retainer part 23 can also move relative to the fixed plier jaw 2 during a pressing. The movement is achieved at least substantially due to an elastic deformation in view of the forces acting on the pressing jaw 6 during the pressing, which are received by the retainer part 23. However, this movability is restricted as a result of a stop which is formed on the retainer part 23 and/or the fixed plier jaw 2 and with corresponding introduction of force or deformation of the retainer part 23, results in a stop connection between the retainer part 23 and the fixed plier jaw 2. When this stop connection is achieved, a shortening of the resilient region of the retainer part 23 is obtained as it were. During a further action of force, the retainer part 23 no longer deviates elastically by a corresponding amount by which it had deviated previously with a corresponding amount of force. Nevertheless a further resilience is still achieved.

The stop connection 25 provided in the region of the retainer part 23 associated with the fixed plier jaw 2 is given by a stop which is formed specifically and preferably by a stop section 51. The stop can come to abut against a marginal edge of the retainer part 23. Preferably and in the exemplary embodiment it is shown that the retainer part 23 has a slot 53 in which the stop, here preferably in the form of a pin 52, is received. In the given case, when it is provided in this respect, the slot 53 extends with its central axis directed in the longitudinal direction substantially approximately perpendicular to the previously described central line a of the retainer part 23.

The slot 53 has a width matched to the diameter of the pin 52 whereas the length observed perpendicular thereto can approximately correspond to 1.5 times to approximately twice the pin diameter.

The retainer part 23 is suitable for bending deformation in the course of an application of pressing force, in particular for a bending deformation substantially contrary to the bringing-together direction r and transversely to the central line a. In the course of his bending deformation which is initially and substantially obtained as a result of the clamping in the region of the fixed connection 27 to the plier jaw 2, the slot 53 in the retainer part 23 can come to abut against the stop section 51 or the pin 52. The retainer part 23 only experiences a support in this abutment position in the region of the stop connection 25 which, in the course of a further introduction of pressing force, for example, during a pressing of larger-diameter workpieces W, brings about a predominant bending stress of the retainer part 23 possibly merely in the retainer part section 24.

The workpiece W to be pressed can, as is preferred and shown, comprise a core end sleeve 57 which embraces conductor ends 58 of a cable. Due to the pressing, a withdrawal-proof connection of core end sleeve 57 and conductor ends 58 is achieved as a result of deformation of the wall 59 of the core end sleeve 57.

The retainer part 23 is preferably configured as a flat part having a smaller thickness d compared with its length l. In the depicted exemplary embodiment, the length l approximately corresponds to 15 to 30 times, further approximately 20 times the thickness d. The retainer part preferably also abuts almost directly against a corresponding flat side of the fixed plier jaw 2.

Furthermore, in particular in the respectively central region, in any case in the respectively central length third, of the retainer part section 24 and the retainer part section 26, a smallest cross-section b, b' observed transversely to the central line a is obtained. The smallest cross-section (dimension b') between the fixed connection 27 and the stop connection 25 is in this case preferably larger than the smallest cross-section (dimension b) between the stop connection 25 and the retainer region for the first pressing jaw 6. The dimension of the smallest cross-section 6 between the stop connection 25 and the pressing jaw retainer can correspond to 0.3 to 0.8 times the dimension of the smallest cross-section b' between the stop connection 25 and the fixed connection 27.

In the depicted exemplary embodiment, when viewed in the direction of extension of the central line a starting from the retainer region for the first pressing jaw 6 in the direction of the stop connection 25 passing through over half to ⅔ of the relevant length of the retainer part section 24, a smaller cross-sectional dimension b is given compared with the cross-sectional dimension b' over the entire extension length of the retainer part section 26 extending between the stop connection 25 and the fixed connection 27. Accordingly, a region of greatest deformation can be obtained in the retainer part section 24 between the stop connection 25 and the retainer region for the first pressing jaw 6.

As a result, a favourable force-distance compensation is made possible in order to be able to press workpieces W having different diameters without changing the pressing jaws 6 and 7. The respective lever travel in particular of the handle part 5 is independent of the workpiece diameter right into a position in which the pawl 20 leaves the ratchet section 19. The movable handle part 5 released as a result can be pivoted back whilst opening or distancing the pressing jaws 6 and 7 from one another.

Furthermore, the force-distance compensation is supported as a result of a possible bending deformation in the region of the lever part 15 assigned to the movable plier jaw 3 or directly forming this plier jaw 3, thus in particular in the lever section 16 obtained between the axis of rotation x and the pivot joint 47 of the associated pressing jaw 7 which, when viewed transversely to the essential longitudinal extension thereof, has a smaller minimal cross-sectional dimension than the lever section 17 between the axis of rotation x and the pivot connection of the movable handle part 5.

FIGS. 29 to 34 show a pressing jaw pair with pressing jaws 6 and 7 in a second embodiment. The ribs 29 or 31 of the two pressing jaws 6 and 7 are provided with a protuberance 60 in relation to the respective ridge line 56.

In the longitudinal extension direction of the ridge line 56, respectively one straight-running region 61 is obtained on both sides of the protuberance 60. These rectilinearly running regions 61 are arranged along a base line 62 connecting the ends of the ridge line 56, beyond which base line 62 the protuberance 60 is directed in the direction of the pressing jaw opening 33.

Figure 31:
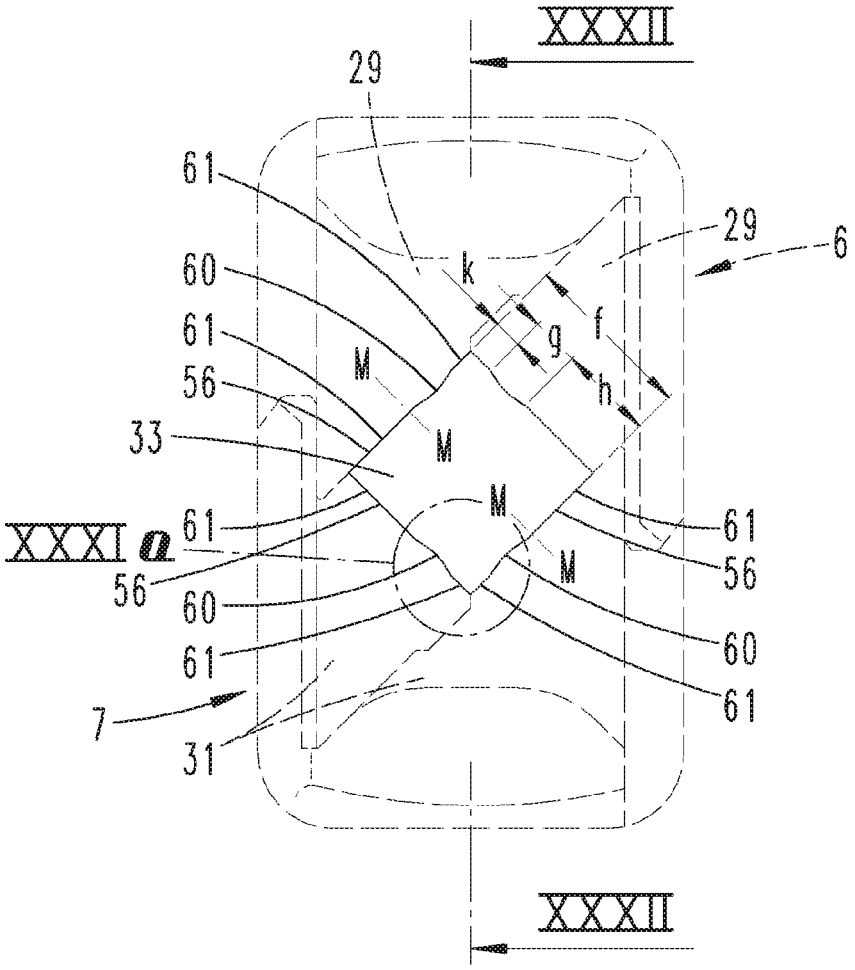
FIG. 31 shows in a schematic and enlarged diagram the pressing jaw opening delimited by the ribs of the pressing jaws of the second embodiment.
Figure 31A:
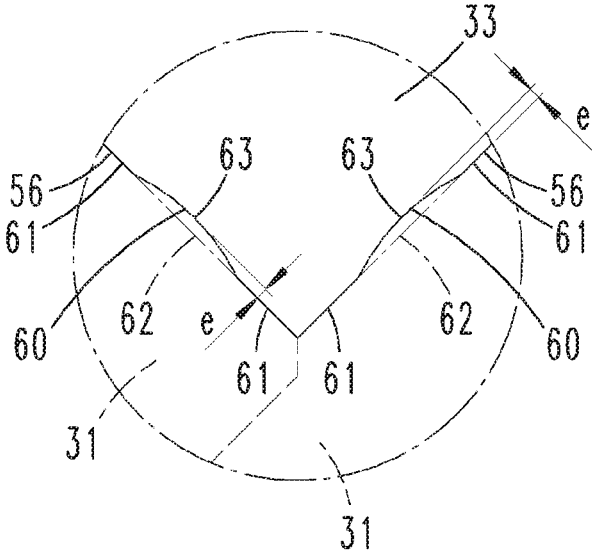
FIG. 31*a* shows the enlargement of the region XXXIa in FIG. 31.

According to the depicted exemplary embodiment, the protuberance 60 can be a convex shape, circular-line-section-shaped in relation to an outline according to the diagram in FIG. 31.

The protuberances 60 of a rib family 54 or 55 lie on the rib front face 30, 32 overlapping one another with reference to a view towards the pressing jaw 6 or 7.

The extension dimension e of the protuberance 60 beyond the imaginary base line 62, in particular in the region of a highest point 63 located at the greatest distance perpendicular to the base line 62 corresponds in the depicted exemplary embodiment approximately to a fortieth to a thirtieth of the greatest free extension length f of the base line 62, which is established when the pressing jaw opening 33 is initially closed (cf. FIG. 31 and the relevant enlargement).

The length g of the protuberance 60 observed in the direction of extension of the base line 62 can, according to the depicted exemplary embodiment, correspond to approximately a seventh to quarter, further approximately a fifth of the previously described extension length f of the base line 62.

As can be further identified in particular from the diagram in FIG. 31, the protuberance 60 is arranged with reference to the associated base line 62 of the ridge line 56 at least when the pressing jaw opening 33 is initially closed in an off-centre manner in relation to a central line M running perpendicular to the base line 62. Thus, the protuberance 60 can be further arranged completely off-centre accordingly over its entire length g.

Furthermore, the off-centre offset of the protuberance 60 can be given with reference to the central axis M in the direction of the crossing base line 62 running at right angles to the base line 62 having the protuberance 60 of the directly adjacent rib 29 or 31 of the same pressing jaw 6 or 7. With a view to the rib front face 30 or 32, the protuberance 60 is configured to be offset in an off-centre manner in relation to the central axis M in the direction of the gusset formed by the ribs of the same pressing jaw.

A first rectilinearly running region 61 of the ridge line 56 extends from this gusset, having a length k which can correspond to 0.3 to 0.8 times the length g of the protuberance 60, preferably approximately 0.5 times.

The varying further rectilinear region 61 of the ridge line 56 adjoining the protuberance 60 is selected to be substantially larger with regard to its length h than the previously described rectilinear region, thus has a length h which can correspond to 1.5 to 2.5 times, further approximately twice the length of the protuberance 60.

Figure 32:
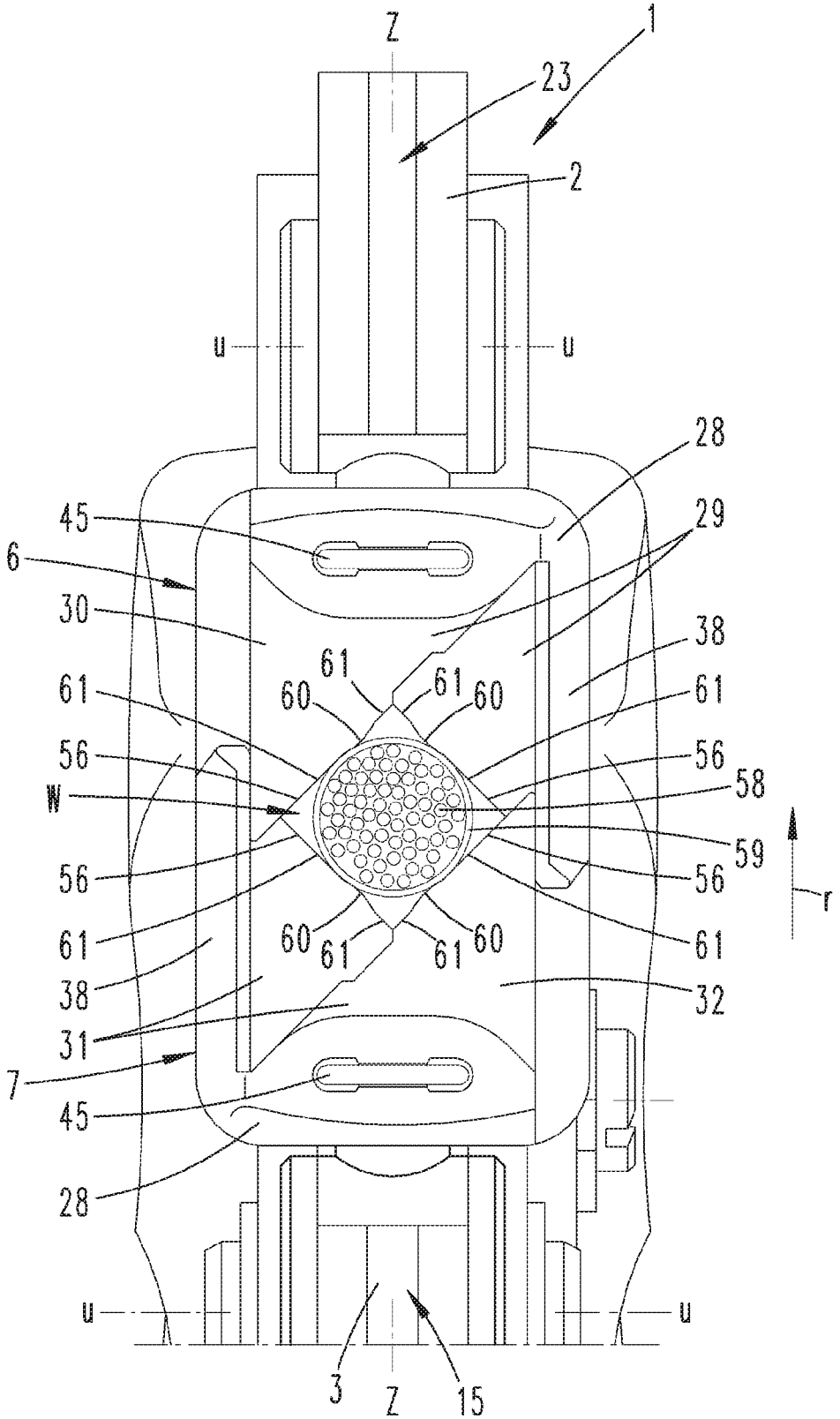
FIG. 32 shows a diagram corresponding to FIG. 29 with a workpiece inserted in the pressing jaw opening for pressing.
Figure 33:
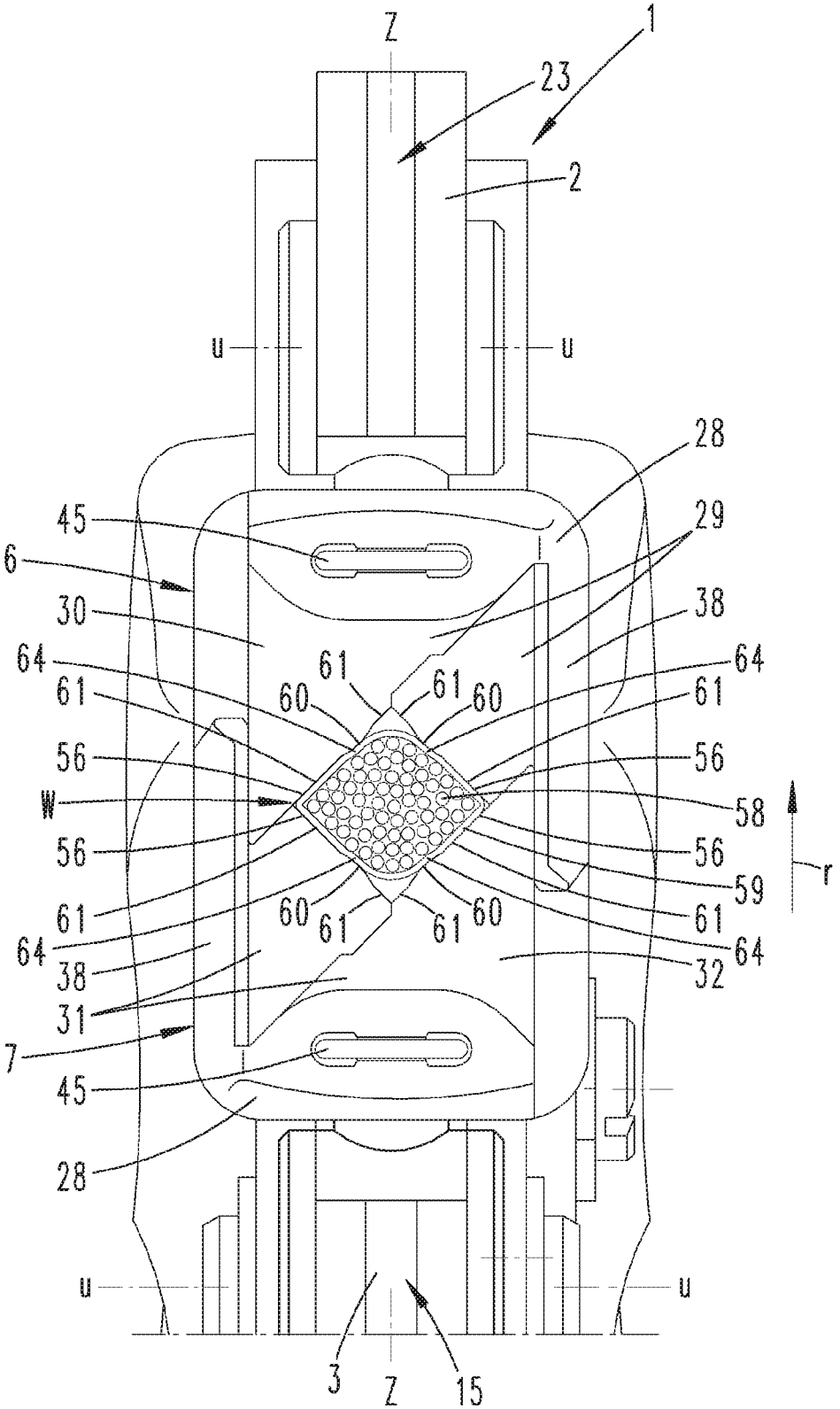
FIG. 33 shows a follow-up position to FIG. 32 in the course of a pressing process.
Figure 34:
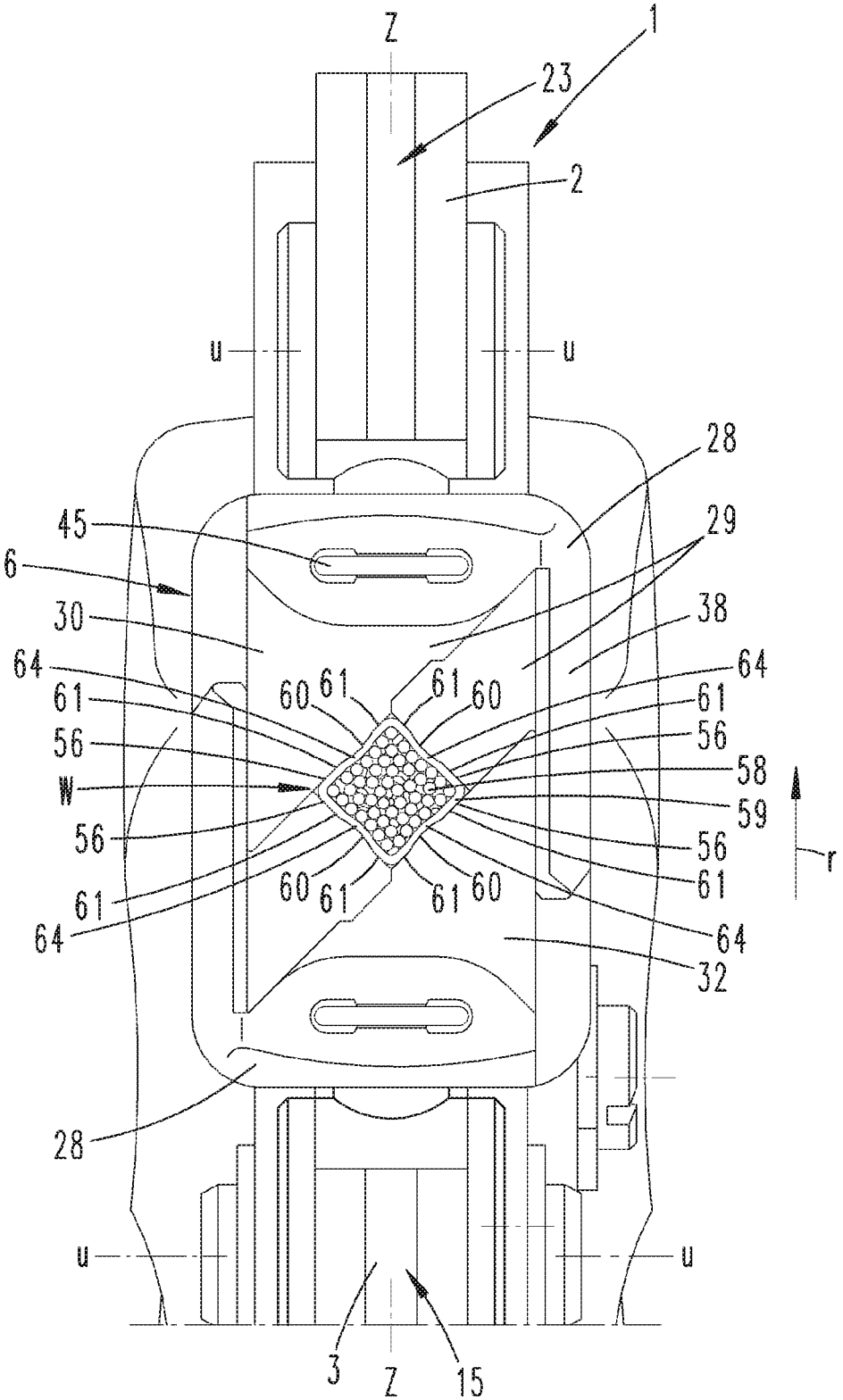
FIG. 34 shows a follow-up diagram to FIG. 33 relating to the pressing end position.

FIGS. 32 to 34 show successive intermediate positions in the course of a pressing process using pressing jaws of the second embodiment.

A workpiece W in the form of a core end sleeve 57 with conductor ends 58 combined therein is accommodated in the pressing jaw opening 33. The wall 59 of the core end sleeve 57 initially has in the pressing region, i.e. in the non-deformed state, a circular cross-section according to the diagram in FIG. 32. The conductor ends 58 are received loosely, i.e. not in a withdrawal-proof manner in this position in the core end sleeve 57.

In the course of moving the ribs 29 and 31 of the pressing jaws 6 and 7, the protuberances 60 in the region of the rib-side ridge lines 56 initially come up against the wall outer surface of the core end sleeve 57.

With the aid of the protuberances 60 in the course of the further moving of the pressing jaws 6 and 7 into one another, concavely running wall sections 64 are formed in the wall 59 of the core end sleeve 57. In this case, preferably at the same time a deflection of the wall material into the gusset formed transversely to the bringing-together direction r between the ribs 29 and 31 of the pressing jaws 6 and 7 pointing towards one another is achieved as a result of deformation and in so doing, rectilinear running wall sections corresponding in cross-section are formed along the possibly longer rectilinear regions 61 of the ridge lines 56 in this pressing jaw position. Two directly following such rectilinearly running wall sections of the core end sleeve 57 in this case enclose an angle of 90 degrees with respect to one another.

These rectilinearly running wall sections end in concavely running wall sections 64 formed by the protuberances 60 (cf. FIG. 33).

In the course of the moving into one another of the pressing jaws 6 and 7 until the pressing end position according to FIG. 34 is reached, the wall 59 of the core end sleeve 57 is preferably also urged into the gusset pointing in the bringing-together direction r between the ribs of a pressing jaw 6 and 7, accordingly adapted to the shorter rectilinearly running regions 61 of the ridge line 56 adjoining the protuberance 60.

For pressing smaller workpiece sections the pressing jaws 6 and 7 move further together. The pressing takes place with a pressing jaw opening 33 having a smaller cross-section. As a result of the intermeshing, this results in a shortening of the length of the sections of the longer rectilinearly running region 61 used for the pressing. Thus, approximately equal-length rectilinearly running wall sections can adjoin the pressed workpiece W, for example, a core end sleeve 57, relative to a cross-section on both sides of the concave wall section 64. The entire wall leg, in particular with the smallest cross-sections, can substantially have a concave curvature, optionally going over directly into the corner regions.

Figure 35:
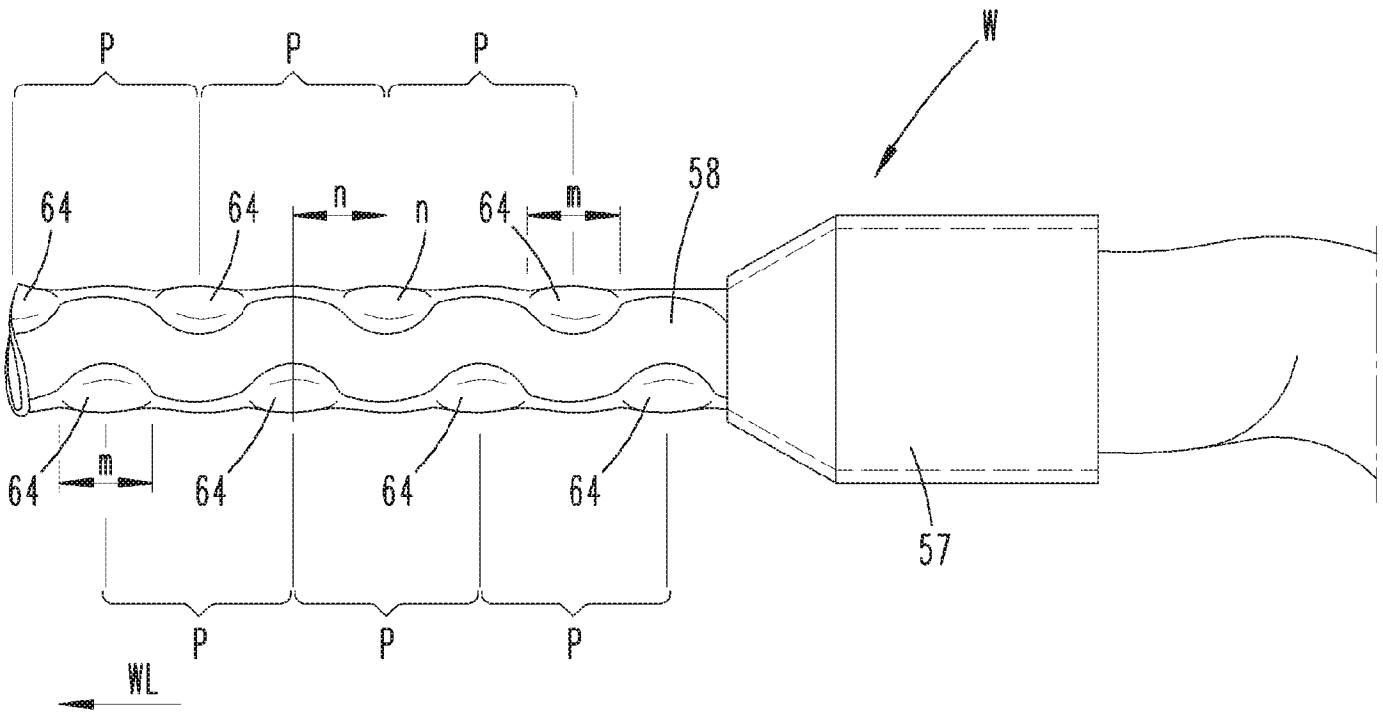
FIG. 35 shows in a detailed diagram a workpiece pressed using a pressing jaw pair of the second embodiment according to FIG. 29 in the form of a core end sleeve receiving conductor ends.

In the deformed end position of the core end sleeve 57, this therefore results in an overall substantially rectangular, further in particular square cross-section with concavely running wall sections 64, which are established on alternate sides according to the material thickness of the ribs 29 and 31 on the wall side of the core end sleeve 57 according to the diagram in FIG. 35. The upper concavely running wall sections 64 shown in this diagram are formed by the protuberances 60 of the ribs 29 of one of the rib pairs 54 or 55 in the pressing jaw 6 whereas the lower concavely running wall sections 64 shown in the diagram are formed by the protuberances 60 of the ribs 31 of one rib family 54 or 55 of the pressing jaw 7.

The width m of a concavely running wall section 64 observed in the workpiece longitudinal direction WL is in this case dependent on the rib thickness or thickness of the front face 34 observed perpendicular to the rib longitudinal direction R, which at the same time also preferably predefines the relevant thickness of the protuberance 60.

The offset of the upper concavely running wall sections 64 with respect to the lower concavely running wall sections 64 corresponds to the offset of the intermeshing ribs of a pressing jaw 6 or 7, wherein a distance n is established which approximately corresponds to the offset of the intermeshing ribs of a pressing jaw 6 or 7, wherein the distance n is established which approximately corresponds to the width dimension m. This further results in a distance dimension p between two concavely running wall sections 64 arranged next to one another in the workpiece longitudinal direction WL, which distance dimension p is dependent on the distance dimension of two aligned ribs of a rib family 54 or 55 of a pressing jaw 6 or 7 with respect to one another. Thus, as is also preferred, the distance dimension p can approximately correspond to twice the width m of a wall section 64.

As shown in FIG. 34, as a result of the proposed method using pressing jaws with protuberances 60, a core end sleeve 57 filled "homogeneously" completely with conductor ends 58 can be obtained, which does not leave any empty regions in the cross-section which could result in a loosening of the grasped conductor ends 58.

The preceding explanations serve to explain the inventions covered overall by the application which also in each case independently further develop the prior art at least by the following feature combinations, wherein two, several or all of these feature combinations can also be combined, namely:

Two pressing jaws 6, 7 provided for opposite arrangement in crimping pliers 1, characterized in that a guide surface running transversely to the rib longitudinal direction is formed outside a working region of the ribs 29, 31, which cooperates with a guide protrusion 38 starting from the opposite pressing jaw 6, 7.

Crimping pliers characterized in that guide protrusions 38 are formed opposite one another on each pressing jaw 6, 7 relative to the rib longitudinal direction.

Crimping pliers characterized in that the multiple opposite guide protrusions 38 are formed on a first side of the pressing jaw 6, 7 with an insertion opening 39 remaining transverse to the rib longitudinal direction.

Pressing jaws 6, 7 for crimping pliers 1 characterized in that the front face 34 seen in a cross-section transverse to the rib longitudinal direction has a rounded contour line 35 which projects further at the centre.

Pressing jaws, characterized in that the contour line 35 runs in a continuously curved manner, optionally with the exception of a flattened portion 37 co-formed the furthest projecting region.

Pressing jaws, characterized in that the curvature extends as far as the inlet into a flank contour 36 of the ribs 29, 31 extending rectilinearly in the bringing-together direction r.

Crimping pliers characterized in that the pressing jaws 6, 7 are rotatable about a twist axis z directed in the direction of bringing together the pressing jaws 6, 7 and that the pressing jaws 6, 7 are also rotatable about the twist axis z in the brought-together state without hindrance by the plier jaw 2, 3.

Crimping pliers, characterized in that a plier jaw 2, 3 has a surface 42 facing the associated pressing jaw 6, 7 and that a guide protrusion 38 in the brought-together state of the pressing jaws 6, 7 leaves a distance from the facing surface 42 of the plier jaw 2, 3 with its surface 40 giving in the bringing-together direction r.

Crimping pliers, characterized in that a pressing jaw 6, 7 has a pivot pin 43 which is mounted for pivoting in one of the plier jaws 2, 3, wherein the pivot pin 43 is held dismountably in the pressing jaw 6, 7.

Crimping pliers, characterized in that the holder of the pivot pin 43 is formed by a plug-in part 45 which is received positively both at the pivot pin 43 and also at the pressing jaw 6, 7.

Crimping pliers, characterized in that the plug-in part 45 is configured to be U-shaped.

Crimping pliers, characterized in that the plug-in part 45 is configured to be resilient.

Crimping pliers, characterized in that the pivot pin 43 is received in the associated plier jaw 2, 3 in a pivot joint 47 for pivoting about a pivot axis u running transversely to the twist axis z, wherein when the pressing jaw 6, 7 is released from the opposite plier jaw 2, 3, the pressing jaws 6, 7 can be twisted individually or together about the twist axis z from the plier mouth.

Pressing jaws, characterized in that the ridge lines 56 of a rib family 54, 55 in each case in the said view have a protuberance 60 which projects into the pressing jaw opening 33.

Pressing jaws, characterized in that the ridge lines each have a straight-running region 61.

Pressing jaws, characterized in that a greatest extension of the protuberance 60 over a linearly extended straight region of the ridge line 56 as an imaginary base line 62 in the direction of the pressing jaw opening 33 corresponds to a fiftieth to a tenth of the greatest extension of the base line 62 established when the pressing jaw opening 33 is initially closed.

Pressing jaws, characterized in that the measured length g of the protuberance 60 measured in the direction of extension of the base line 62 corresponds to a tenth to a third of the greatest extension of the ridge line 56 extended linearly over the straight region as imaginary base line 62 established when the pressing jaw opening is initially closed.

Pressing jaws, characterized in that a highest point 63 of the protuberance 60 relative to the greatest extension of the ridge line 56 extended linearly over the straight region 61 as imaginary base line 62 established when the pressing jaw opening is initially closed is offset from a longitudinal centre of the rib 29, 31 with respect to the base line 62 of the next following rib 29, 31 in the adjacent arrangement of the same pressing jaw 6, 7, which base line adjoins the base line 62 substantially at right angles to the base line 62.

A method characterized in that by using the pressing jaws 6, 7 according to one of claims 14 to 18, the pressing jaws 6, 7 initially with the protuberances 60 formed on the ribs 29, 31 are brought into contact with the wall outer surface of the core end sleeve 57 and with the aid of the protuberances 60, during further pressing concavely running wall sections 64 are formed at the substantially rectangular wall 59 of the deformed core end sleeve 57.

A method characterized in that a concavity is formed asymmetrically in relation to a central line M aligned perpendicular to a ridge base line which otherwise runs linearly.

All the disclosed features are (for themselves and also in combination with one another) essential to the invention. The disclosure of the application herewith includes the disclosure content of the relevant/appended priority documents (copy of the prior application) in its full content, also for the purpose of incorporating features of these documents in claims of the present application. The subclaims characterize, even without the features of a claim to which reference is made, with their features independent inventive further developments of the prior art, in particular in order to make divisional applications on the basis of these claims. The invention specified in each claim can additionally have one or more of the features specified in the preceding description, in particular provided with reference numbers and/or specified in the reference list. The invention also relates to design forms in which individual ones of the features mentioned in the preceding description are not implemented, in particular insofar as they are clearly dispensable for the respective usage purpose or can be replaced by other means having technically the same effect.

REFERENCE LIST

1 Crimping pliers
2 Plier jaw
3 Plier jaw
4 Handle part
5 Handle part
6 Pressing jaw
7 Pressing jaw
8 Jaw part
9 Handle sleeve
10 Handle sleeve
11 Stop section
12 Pin
13 Spring
14 Pin
15 Lever part
16 Lever section
17 Lever section
18 Ratchet arm
19 Ratchet section
20 Pawl
21 Tension spring
22 Actuator
23 Retainer part
24 Retainer part section
25 Stop connection
26 Retainer part section
27 Fixed connection
28 Base body
29 Rib
30 Rib front face
31 Rib
32 Rib front face
33 Pressing jaw opening
34 Front face
35 Contour line
36 Flank contour
37 Flattened portion
38 Guide protrusion
39 Insertion opening
40 Surface

41 Lower surface
42 Surface
43 Pivot pin
44 Recess
45 Plug-in part
46 Channel
47 Pivot joint
48 Pivot pin
49 Guide jaw
50 Cavity
51 Stop section
52 Pin
53 Slot
54 Rib family
55 Rib family
56 Ridge line
57 Core end sleeve
58 Conductor ends
59 Wall
60 Protuberance
61 Region
62 Base line
63 Highest point
64 Wall section
a Central line
b Cross-section
b' Cross-section
c Distance
d Thickness
e Extension dimension
f Extension length
g Length
h Length
k Length
l Length
m Width
n Distance
p Distance
r Bringing-together direction
u Pivot axis
x Axis of rotation
y Axis of rotation
z Twist axis
F Guide surface
H Height
K Knee joint arrangement
M Central line
R Rib longitudinal direction
S Front face
W Workpiece
WL Workpiece longitudinal direction

The invention claimed is:

1. Two pressing jaws (6, 7), arranged opposite each other and being configured for arrangement in crimping pliers (1), wherein the pressing jaws (6, 7) each have a base body and ribs (29, 31) running in a rib longitudinal direction and disposed in the base body, the ribs being configured to interleave with each other during pressing of the jaws toward each other, wherein when viewed perpendicular to the rib longitudinal direction (R), the ribs are substantially triangular each rib has an outer rib front face (30) running perpendicular to a width of the base body (28) and perpendicular to the rib longitudinal direction (R), wherein further starting from the rib front face (30), a pressing direction front face facing the opposite pressing jaw extending in the rib longitudinal direction (R) decreases in the direction of the base body (28) and forms an oblique angle with the base body, wherein one of the two pressing iaws has a guide surface (F) running transversely to the rib longitudinal direction (R) outside of a an interleaving region of the ribs and the other of the two pressing jaws has a guide protrusion (38), the guide surface cooperating with the guide protrusion (38) to guide the pressing jaws during opening and closing, and wherein the guide surface is disposed on an end region of one or more of the ribs of the one pressing jaw or on a guide protrusion of the other pressing jaw, wherein the guide protrusion (38) comprises at least one guide protrusion on each pressing iaw, and each guide protrusion is connected to the respective base body to form a guide in the rib longitudinal direction, the protrusions having a length in a closing direction (r) of the pressing jaws, which substantially corresponds to a length observed in a same direction of the ribs (29 or 31) arranged on the associated base body (28), wherein each protrusion (38) extends transversely to the rib longitudinal direction over a dimension which is less than a width of an arrangement of all of the ribs (29, 31) on the associated base body.

2. The pressing jaws according to claim 1, wherein the guide protrusion (38) extends along a front face of the ribs of the one pressing jaw.

3. The pressing jaws according to claim 1, wherein the two pressing jaws (6, 7) have the same design as one another with regard to the configuration and arrangement of the ribs, each jaw comprising triangular ribs (31) with outer rib front faces (32).

4. The pressing jaws according to claim 1, wherein the guide protrusion comprises opposite guide protrusions (38) formed on each pressing jaw (6, 7) relative to the rib longitudinal direction (R).

5. The pressing jaws according to claim 4, wherein the guide protrusion comprises multiple opposite guide protrusions (38) formed on a first side of one of the pressing jaws (6, 7), with an insertion opening (39) disposed between the guide protrusions (38) and transverse with respect to the rib longitudinal direction.

6. The pressing jaws according to claim 1, wherein the guide protrusion projects beyond a dividing plane of the pressing jaws.

* * * * *